US011180280B2

(12) United States Patent
Buchenan et al.

(10) Patent No.: US 11,180,280 B2
(45) Date of Patent: Nov. 23, 2021

(54) SECONDARY PACKAGING SYSTEM FOR PRE-PACKAGED PRODUCTS

(75) Inventors: Robert G. Buchenan, Sandwich, MA (US); William Harvey, Plymouth, MA (US); Mark Sinn, Plymouth, MA (US); Joseph Sullivan, Duxbury, MA (US); Terry Staed, St. Louis, MO (US)

(73) Assignee: CDF Corporation, Plymouth, MA (US)

( * ) Notice: Subject to any disclaimer, the term of this patent is extended or adjusted under 35 U.S.C. 154(b) by 0 days.

(21) Appl. No.: 13/297,434

(22) Filed: Nov. 16, 2011

(65) Prior Publication Data

US 2012/0261411 A1 Oct. 18, 2012

Related U.S. Application Data

(60) Provisional application No. 61/473,596, filed on Apr. 8, 2011, provisional application No. 61/414,422, filed on Nov. 16, 2010.

(51) Int. Cl.

| | |
|---|---|
| ***B65D 5/60*** | (2006.01) |
| ***B65D 21/02*** | (2006.01) |
| ***B65D 5/355*** | (2006.01) |
| ***B65D 21/08*** | (2006.01) |
| ***B65D 5/50*** | (2006.01) |

(52) U.S. Cl.

CPC ..... *B65D 5/60* (2013.01); *B65D 5/0005* (2013.01); *B65D 5/503* (2013.01); *B65D 21/0237* (2013.01); *B65D 21/08* (2013.01)

(58) Field of Classification Search

CPC ..... B65D 5/503; B65D 5/0005; B65D 5/60; B65D 21/08; B65D 21/0237; B65D 81/3834; B65D 81/3825; B65D 81/3813; F25D 3/08; F25D 17/042

USPC ... 220/23.87, 345.1, 359.1, 359.2, 602, 623, 220/676, 833, 839, 62, 62.1; 206/427

See application file for complete search history.

(56) References Cited

U.S. PATENT DOCUMENTS

| | | | |
|---|---|---|---|
| 875,780 | A | 1/1908 | Coats |
| 931,808 | A | 8/1909 | Smith |
| 1,120,058 | A | 12/1914 | Hutto |
| 1,132,000 | A | 3/1915 | Dight |

(Continued)

FOREIGN PATENT DOCUMENTS

| | | |
|---|---|---|
| CA | 1159379 | 12/1983 |
| CA | 2156796 A1 | 2/1997 |

(Continued)

OTHER PUBLICATIONS

International Search Report dated Mar. 15, 2012 for International Application No. PCT/US2011/060919.

(Continued)

*Primary Examiner* — Anthony D Stashick
*Assistant Examiner* — James M Van Buskirk
(74) *Attorney, Agent, or Firm* — Dorsey & Whitney LLP

(57) ABSTRACT

A liner system for use with a carton of pre-packaged products to protect the carton from moisture may include a substantially continuous liner including a bottom panel and side and end wall panels extending upward from the bottom panel and defining an open top and the liner may be adapted for positioning in the carton prior to placement of the pre-packaged products and may include positioning features configured to maintain a position of the pre-packaged products.

23 Claims, 33 Drawing Sheets

(56) References Cited

U.S. PATENT DOCUMENTS 1,135,866 A 4/1915 Turner
1,875,497 A 9/1932 Richardson et al.
1,975,198 A 10/1934 Doleman
2,083,776 A 6/1937 Ferguson
2,155,057 A 4/1939 Moore
2,260,064 A 10/1941 Stokes
2,333,587 A 11/1943 Salfisberg
2,339,156 A 1/1944 Davis
2,339,665 A 1/1944 Man
2,352,503 A 6/1944 Walton
2,446,308 A 8/1948 Smith
2,533,554 A 12/1950 Byerly
2,638,263 A 5/1953 Jesnig
2,720,998 A 10/1955 Potter
2,738,796 A 3/1956 Chadwick
2,757,669 A 8/1956 Gewecke et al.
2,791,367 A 5/1957 Mefford
2,799,314 A 7/1957 Dreyer et al.
2,853,223 A 9/1958 Paflas
2,902,202 A 9/1959 Fallert
2,930,423 A 3/1960 Cunningham et al.
2,950,037 A 8/1960 Orsini
2,951,628 A 9/1960 Grussen
2,956,839 A 10/1960 Hermanns
2,973,119 A 2/1961 Parker
3,006,257 A 10/1961 Orsini
3,039,656 A 6/1962 Wentz
3,044,515 A 7/1962 Eades
3,087,491 A 4/1963 Gewecke et al.
3,119,548 A 1/1964 Cook et al.
3,143,277 A 8/1964 La Fleur
3,208,658 A 9/1965 Membrino
3,217,949 A * 11/1965 Davis ..... 222/480
3,224,640 A 12/1965 Schneider et al.
3,244,576 A 4/1966 Swartz
3,253,764 A 5/1966 Goetschius et al.
3,275,197 A 9/1966 Eklund
3,289,386 A 12/1966 Farmer
3,294,270 A * 12/1966 Geisler ..... 217/21
3,319,684 A 5/1967 Calhoun
3,335,858 A * 8/1967 Sibille ..... 206/392
3,349,991 A 10/1967 Kessler
3,367,380 A 2/1968 Dickey
3,370,774 A 2/1968 Hopf
3,384,106 A 5/1968 Isbrandtsen
3,386,645 A 6/1968 Powell
3,415,440 A 12/1968 Watters
3,434,652 A 3/1969 Shore
3,447,732 A 6/1969 Deckys
3,462,067 A 8/1969 Shore
3,510,142 A 5/1970 Erke
3,550,662 A 12/1970 Remke et al.
3,559,847 A 2/1971 Goodrich
3,620,399 A * 11/1971 Rapeaud ..... 215/12.1
3,624,776 A * 11/1971 Gordon ..... 206/392
3,670,916 A * 6/1972 Alpert ..... 220/23.87
3,709,426 A 1/1973 Farkas
3,739,977 A 6/1973 Shapiro et al.
3,740,238 A 6/1973 Graham
3,761,013 A 9/1973 Schuster
3,836,217 A 9/1974 Shiina
3,853,238 A 12/1974 Luisada et al.
3,868,891 A 3/1975 Parish
3,885,727 A 5/1975 Gilley
3,890,762 A 6/1975 Ernst et al.
3,951,284 A 4/1976 Fell et al.
3,965,953 A 6/1976 Becker et al.
3,989,157 A 11/1976 Veenema
3,995,806 A 12/1976 McSherry
3,997,677 A 12/1976 Hirsch
4,011,798 A 3/1977 Bambara et al.
4,025,048 A 5/1977 Tibbitts
4,047,633 A * 9/1977 Trombly ..... 220/592.2
4,056,913 A 11/1977 Bamburg
4,085,244 A 4/1978 Stillman
4,094,460 A 6/1978 Scanga et al.
4,105,121 A * 8/1978 Mascetti ..... 206/592
4,141,466 A 2/1979 Gordon
4,169,548 A 10/1979 Bond
4,174,051 A 11/1979 Edwards et al.
4,177,907 A 12/1979 Funaioli et al.
4,184,527 A 1/1980 Kawamura et al.
4,211,226 A * 7/1980 Schaar ..... 604/370
4,239,111 A 12/1980 Conant et al.
4,267,960 A 5/1981 Lind et al.
4,270,533 A 6/1981 Andreas
4,305,535 A 12/1981 Brundige et al.
4,309,466 A 1/1982 Stillman
4,328,923 A 5/1982 Graser
4,362,199 A 12/1982 Futerman
4,397,415 A 8/1983 Lisiecki
4,421,253 A 12/1983 Croley
4,430,084 A * 2/1984 Deaton ..... 604/317
4,444,355 A 4/1984 Cary
4,448,345 A 5/1984 Helms
4,449,646 A 5/1984 Bonerb et al.
4,457,456 A 7/1984 Derby et al.
4,461,402 A 7/1984 Fell et al.
4,466,553 A 8/1984 Zenger
4,476,998 A 10/1984 Bonerb et al.
4,482,053 A 11/1984 Alpern
4,482,074 A 11/1984 Lalley
4,518,097 A 5/1985 Milton et al.
4,524,459 A 6/1985 Titchenal
4,548,321 A 10/1985 Mockesch et al.
4,548,852 A 10/1985 Mitchell
4,560,090 A 12/1985 Okushita
4,561,107 A 12/1985 Herder
4,596,040 A 6/1986 LaFleur et al.
4,597,102 A 6/1986 Nattrass
RE32,232 E 8/1986 Bonerb et al.
4,625,908 A 12/1986 Emery
4,636,190 A 1/1987 Herder
4,671,453 A 6/1987 Cassidy
4,673,112 A 6/1987 Bonerb
4,674,127 A 6/1987 Yamada et al.
4,676,373 A 6/1987 Schneider
4,715,508 A 12/1987 Schurch
4,718,577 A 1/1988 Morris et al.
4,730,942 A 3/1988 Fulcher
4,732,301 A 3/1988 Tobias
4,781,472 A 11/1988 LaFleur et al.
4,783,178 A 11/1988 Herder
4,784,885 A 11/1988 Carespodi
4,790,029 A 12/1988 LaFleur et al.
4,790,436 A 12/1988 Nakamura
4,796,788 A 1/1989 Bond
4,804,113 A 2/1989 Ciaccio
4,850,506 A 7/1989 Heaps, Jr.
4,874,258 A 10/1989 Marino
4,898,301 A 2/1990 Schick
4,917,255 A 4/1990 Foy et al.
4,923,077 A 5/1990 Van Iperen et al.
4,924,048 A 5/1990 Bunce
4,931,034 A 6/1990 Wagner
4,941,754 A 7/1990 Murdock
4,972,953 A 11/1990 Friedman
4,997,108 A 3/1991 Hata
4,998,990 A 3/1991 Richter et al.
5,002,194 A 3/1991 Nichols
5,020,922 A 6/1991 Schirmer
5,025,982 A 6/1991 Lisiecki
5,029,734 A 7/1991 Nichols
5,037,002 A 8/1991 Tschanen
5,040,693 A 8/1991 Podd, Sr. et al.
5,054,644 A 10/1991 Greenslade
5,056,667 A 10/1991 Coogan
5,074,460 A 12/1991 Hanekamp
5,094,359 A 3/1992 Demars
5,096,092 A 3/1992 Devine
5,104,236 A 4/1992 LaFleur
5,120,586 A 6/1992 Nedzu et al.
5,124,388 A 6/1992 Pruett
5,127,893 A 7/1992 LaFleur

(56) References Cited

U.S. PATENT DOCUMENTS 5,156,291 A 10/1992 Mielke
5,167,339 A 12/1992 Takata
5,193,710 A 3/1993 Podd, Sr. et al.
5,195,661 A 3/1993 Light
5,253,763 A 10/1993 Kirkley et al.
5,265,797 A 11/1993 Velge et al.
5,269,414 A 12/1993 D'Hollander
5,290,499 A * 3/1994 Tischler ..... 264/301
5,292,026 A 3/1994 Stolzman
5,302,402 A 4/1994 Dudenhoeffer et al.
5,307,986 A 5/1994 Schuster
5,314,086 A 5/1994 Short
5,314,250 A 5/1994 Lee
5,330,069 A 7/1994 Jamison et al.
5,335,820 A 8/1994 Christianson
5,337,915 A 8/1994 Hall, Jr.
5,338,117 A 8/1994 Kucksdorf et al.
5,341,952 A 8/1994 Goglio
5,344,048 A 9/1994 Bonerb
5,344,065 A 9/1994 Moran
5,350,239 A 9/1994 Strand et al.
5,368,395 A 11/1994 Crimmins
5,388,757 A 2/1995 Lorenzen
5,400,916 A 3/1995 Weber
5,427,306 A 6/1995 Petriekis et al.
5,487,470 A 1/1996 Pharo
5,489,037 A 2/1996 Stopper
5,492,270 A 2/1996 Avery et al.
5,494,394 A 2/1996 Podd et al.
5,499,743 A 3/1996 Blumenkron
5,503,858 A 4/1996 Reskow
5,531,361 A 7/1996 Podd
5,547,284 A 8/1996 Imer
5,549,944 A 8/1996 Abate
5,582,343 A * 12/1996 Dalvey ..... B65D 5/0005 229/101
5,582,887 A 12/1996 Etheredge
5,588,549 A 12/1996 Furtner
5,618,254 A 4/1997 Derby
5,633,058 A 5/1997 Hoffer
5,636,764 A 6/1997 Bonerb
5,660,299 A 8/1997 Harvey
5,692,546 A 12/1997 Podd, Sr. et al.
5,711,444 A 1/1998 Meacham et al.
5,765,723 A 6/1998 Wilcox
5,775,541 A 7/1998 Perkins
5,788,121 A 8/1998 Sasaki et al.
5,799,818 A 9/1998 Ringer
5,851,072 A 12/1998 LaFleur
5,857,612 A * 1/1999 Smith et al. ..... 229/167
5,865,541 A 2/1999 LaFleur
5,915,596 A 6/1999 Credle, Jr.
5,918,984 A 7/1999 LaFleur et al.
5,924,302 A 7/1999 Derifield
5,941,421 A 8/1999 Overman et al.
5,945,145 A 8/1999 Narsutis
5,984,850 A 11/1999 Derby
5,988,422 A 11/1999 Vallot
6,120,181 A 9/2000 Wilcox
6,139,482 A 10/2000 LaFleur
6,164,526 A 12/2000 Dalvey
6,193,416 B1 2/2001 Kawamata et al.
6,234,351 B1 5/2001 Wilcox
6,296,844 B1 10/2001 Takahashi
6,309,105 B1 10/2001 Palumbo
6,325,281 B1 12/2001 Grogan
6,332,711 B1 12/2001 Inuzuka et al.
6,360,558 B1 * 3/2002 Woog ..... 62/457.5
6,371,646 B1 4/2002 LaFleur
6,374,579 B1 4/2002 Muller
6,378,733 B1 4/2002 Boonzaier
6,427,873 B2 8/2002 Wilcox
6,443,617 B2 9/2002 Tetenborg
6,467,652 B2 10/2002 Wilcox et al.
6,527,445 B2 3/2003 LaFleur et al.
6,533,122 B1 3/2003 Plunkett
6,536,687 B1 3/2003 Navis et al.
6,564,992 B1 5/2003 Wegner
6,588,681 B2 7/2003 Rothrum et al.
6,595,441 B2 7/2003 Petrie et al.
6,607,097 B2 8/2003 Savage et al.
6,644,510 B2 11/2003 Kawolics et al.
6,663,018 B2 12/2003 Rothrum et al.
6,752,179 B1 6/2004 Schwartz
6,868,982 B2 3/2005 Gordon
6,883,683 B1 4/2005 Cunningham et al.
6,892,933 B2 5/2005 Sullivan, Jr.
6,910,582 B2 6/2005 Lantz
6,918,532 B2 7/2005 Sierra-Gomez
7,077,309 B2 7/2006 Andrews, Sr.
7,080,750 B2 7/2006 Wein et al.
7,244,064 B2 7/2007 Sullivan, Jr.
7,252,196 B1 * 8/2007 Koefelda ..... B65D 1/246 206/511
7,334,702 B2 2/2008 Cunningham et al.
7,681,732 B2 3/2010 Moehlenbrock
8,541,081 B1 9/2013 Ranganathan
8,567,660 B2 10/2013 Sullivan
2002/0071922 A1 6/2002 Bailey
2002/0148857 A1 10/2002 Savage et al.
2002/0164089 A1 11/2002 LaFleur et al.
2003/0235349 A1 12/2003 Ricahrdson, Jr. et al.
2004/0118741 A1 6/2004 Sullivan, Jr.
2005/0017011 A1 1/2005 Andrews, Sr.
2005/0072181 A1 4/2005 Mogil
2005/0078890 A1 4/2005 Abe et al.
2005/0082303 A1 4/2005 Cantwell
2005/0100252 A1 5/2005 Rivlin et al.
2005/0220369 A1 10/2005 Sullivan, Jr.
2005/0220639 A1 10/2005 Sasaki et al.
2006/0023973 A1 2/2006 Plunkett et al.
2006/0027586 A1 * 2/2006 Longhany et al. ..... 220/676
2007/0076988 A1 4/2007 Sullivan et al.
2007/0201774 A1 8/2007 Plunkett et al.
2010/0278454 A1 11/2010 Huffer
2011/0114714 A1 * 5/2011 Sullivan ..... B65D 5/5425 229/117.3
2011/0225981 A1 * 9/2011 Glaros et al. ..... 62/3.6
2012/0061386 A1 * 3/2012 Parsons ..... 219/734
2012/0261411 A1 10/2012 Buchenan
2013/0206763 A1 8/2013 Sinn
2013/0320019 A1 12/2013 Tinoco
2016/0152400 A1 6/2016 Tinoco

FOREIGN PATENT DOCUMENTS

DE 1486433 C3 4/1969
DE 8906059 11/1989
DE 29620877 2/1997
DE 19643837 5/1998
EP 0098322 A1 1/1984
EP 0276994 A2 8/1988
EP 0362102 A1 4/1990
EP 0796208 B1 3/2000
EP 1277666 A1 1/2003
EP 1415719 A1 5/2004
EP 1435265 A2 7/2004
EP 2484263 A1 8/2012
FR 1331060 A 6/1963
FR 2316151 A2 1/1977
FR 2375113 A1 7/1978
FR 2742129 A1 6/1997
GB 794125 A 4/1958
GB 1591323 6/1981
GB 2194512 A 3/1988
GB 2245883 A 1/1992
GB 2268231 A 1/1994
GB 2323846 A 10/1998
GB 2356854 A 6/2001
GB 2440735 2/2008
JP 64009174 B 2/1989
JP 02139383 A 5/1990
JP 05221451 A 8/1993
JP 06115557 A 4/1994

(56) References Cited

FOREIGN PATENT DOCUMENTS

| | | | |
|---|---|---|---|
| JP | 06122457 | A | 5/1994 |
| JP | 06179455 | A | 6/1994 |
| JP | 06255657 | A | 9/1994 |
| JP | 08104391 | A | 4/1996 |
| WO | 8203838 | A1 | 11/1982 |
| WO | 8911422 | A1 | 11/1989 |
| WO | 93/00274 | A1 | 1/1993 |
| WO | 9832539 | A1 | 7/1998 |
| WO | WO 2002/31417 | | 4/2002 |
| WO | 2002057151 | | 7/2002 |
| WO | 2002064456 | | 8/2002 |
| WO | 2002074226 | A2 | 9/2002 |
| WO | 03059776 | A1 | 7/2003 |
| WO | 2007038438 | A1 | 4/2007 |
| WO | WO 2007/089282 | | 8/2007 |
| WO | WO 2007/136750 | | 11/2007 |
| WO | 2011062969 | A2 | 5/2011 |

OTHER PUBLICATIONS

International Written Opinion dated Mar. 15, 2012 for International Application No. PCT/US2011/060919.

Advertisement, "CFS Developments (Proprietary) Ltd.", Postal Address: P.O. Box 4852 Luipaardsvlei 1743 South Africa, Date unknown, 4 pages.

Advertisement, "Designed with Food in Mind, the Unifold Grade Intermediate Bulk Container", LB Systemer a/s Uni-Fold, Nordgarde 1A-4520 Svinninge Denmark, Date unknown, 5 pages.

Advertisement, "Econobox, A Whole New Dimension, Cost-effective Solutions for Materials Handling", GE Polymer Logistics, Date unknown, 3 pages.

Advertisement, "Introducing the Arena 330 Shipper, It beats the drum and everything else", GE Silicones, A. R. Arena Products, Inc., 2101 Mt. Read Blvd., Rochester, New York, 1465, Date unknown, 4 pages.

Advertisement, "Reusable Container Systems, Industry Leader in quality, innovation and service", Ropak Corporation, Materials Handling Group, A Member of the Linpac Group of Companies, Date unknown, 7 pages.

Advertisement, "Stocklin, Collapsible Container, innovative and Environment-Friendly Packaging", Walter Stocklin AG, Forder Und Lagertechnik, CH-4143 Dornach/Schweiz, Date unknown, 4 pages.

Advertisement, "TNT Container Logistics, Containers for Hazardous Goods, Hazcon & Uni-Fold", Date unknown, 2 pages.

Author Unknown, "TNT: TNT Liquid Discharge Roller Arm", date unknown, 2 pages.

European Patent Office, International Search Report for PCT/US2010/056998, dated May 19, 2011, 5 pages.

* cited by examiner

SECONDARY PACKAGING SYSTEM FOR PRE-PACKAGED PRODUCTS

CROSS-REFERENCE TO RELATED APPLICATIONS

The present application claims priority to U.S. Provisional Application 61/414,422 filed on Nov. 16, 2010 and U.S. Provisional Application 61/473,596 filed on Apr. 8, 2011, each entitled Secondary Packaging System for Pre-Packaged Products, the contents of each of which are hereby incorporated by reference herein in their entireties.

FIELD OF THE INVENTION

The present disclosure relates to packaging and more particularly to a secondary packaging system including a carton and a liner assembly for protecting pre-packaged products during shipping and handling and also facilitating use thereof.

BACKGROUND OF THE INVENTION

Product packaging can come in an array of forms. In some instances, pre-packaged products can be packaged in bags, plastic wraps, cans, bottles, boxes, and other known packaging materials. Once manufactured and pre-packaged, the products are commonly grouped and placed in secondary packaging, such as larger bags or boxes for shipping and handling. With some products, for example soups, the pre-packaged products are unpacked from the secondary packaging before being sold to the consumer. With other products, for example canned or bottled beverages, the pre-packaged products may be sold to the consumer along with the secondary packaging in the form of a case. Upon purchasing the product in the secondary packaging, particularly beverages, the consumer commonly unpacks the pre-packaged canned or bottled beverages and places them in another container such as a refrigerator or cooler to bring the beverage to a suitable temperature for consumption. The secondary packaging is often discarded or recycled and not relied on for further use.

In the case of bottled products, secondary packaging may be involved from the point of manufacture of the pre-packaging bottle. That is, when the bottles are made, they may be placed in secondary packaging and shipped to the beverage manufacturer. There, the bottles may be removed from the secondary packaging, filled with the beverage, sealed, and placed back into secondary packaging for shipping to a retail outlet. Throughout this process of shipping and handling, it is not uncommon to lose up to 3% of pre-packaging glass bottles, due to breakage, from the point of manufacture of the bottle to the point of sale of the pre-packaged product to the consumer.

Improvements are needed to further the use and benefits of passing secondary packaging on to the consumer and to better protect pre-packaging bottles from their point of manufacture to the point of sale of their pre-packaged product.

BRIEF SUMMARY OF THE INVENTION

In one embodiment, a liner system for use with a carton of pre-packaged products to protect the carton from moisture may include a substantially continuous liner including a bottom panel and side and end wall panels extending upward from the bottom panel and defining an open top. The liner may be adapted for positioning in the carton prior to placement of the pre-packaged products and may include positioning features configured to maintain a position of the pre-packaged products.

In one embodiment, a secondary packaging system includes a substantially continuous liner with an open top configured for positioning in an open top of a carton for protecting the carton against moisture, and a lid configured for secured engagement with the liner to close the open top of the liner. The system may also include the carton. In some embodiments, a positioning feature may be provided to maintain the position of pre-packaged products to be placed in the liner.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

DETAILED DESCRIPTION

The present disclosure relates to a secondary packaging system, for example, a case for shipping and handling of bottled beverages such as beer. The case may include a carton or box with an open top, a liner substantially conforming to the interior of the carton or box, and a lid for closing the top of the case. The liner may allow the consumer to use the case as a cooler. That is, the consumer may remove the lid, place ice in the case with the bottled beverage, and replace the lid for transport. As beverages are desired by the consumer, the lid may be opened, a bottled beverage may be pulled from the icy case, and the lid may again be replaced.

In addition, the liner and the lid may have positioning features particularly adapted for maintaining the position of the bottles in the case. As such, the secondary packaging may be used at bottle manufacturing facilities to pack, store, and ship bottles to beverage producers. Once at the beverage producer, the bottles may be removed from the packaging, filled, sealed, and placed in the secondary packaging again for shipment to a retailer. The positioning features of the packaging may reduce damage to the bottles during shipping and handling by reducing or preventing contact between the bottles. Accordingly, losses associated with bottle breakage during shipping and handling by the bottle manufacturer, the beverage manufacturer, and retailers may be reduced.

Figure 1:
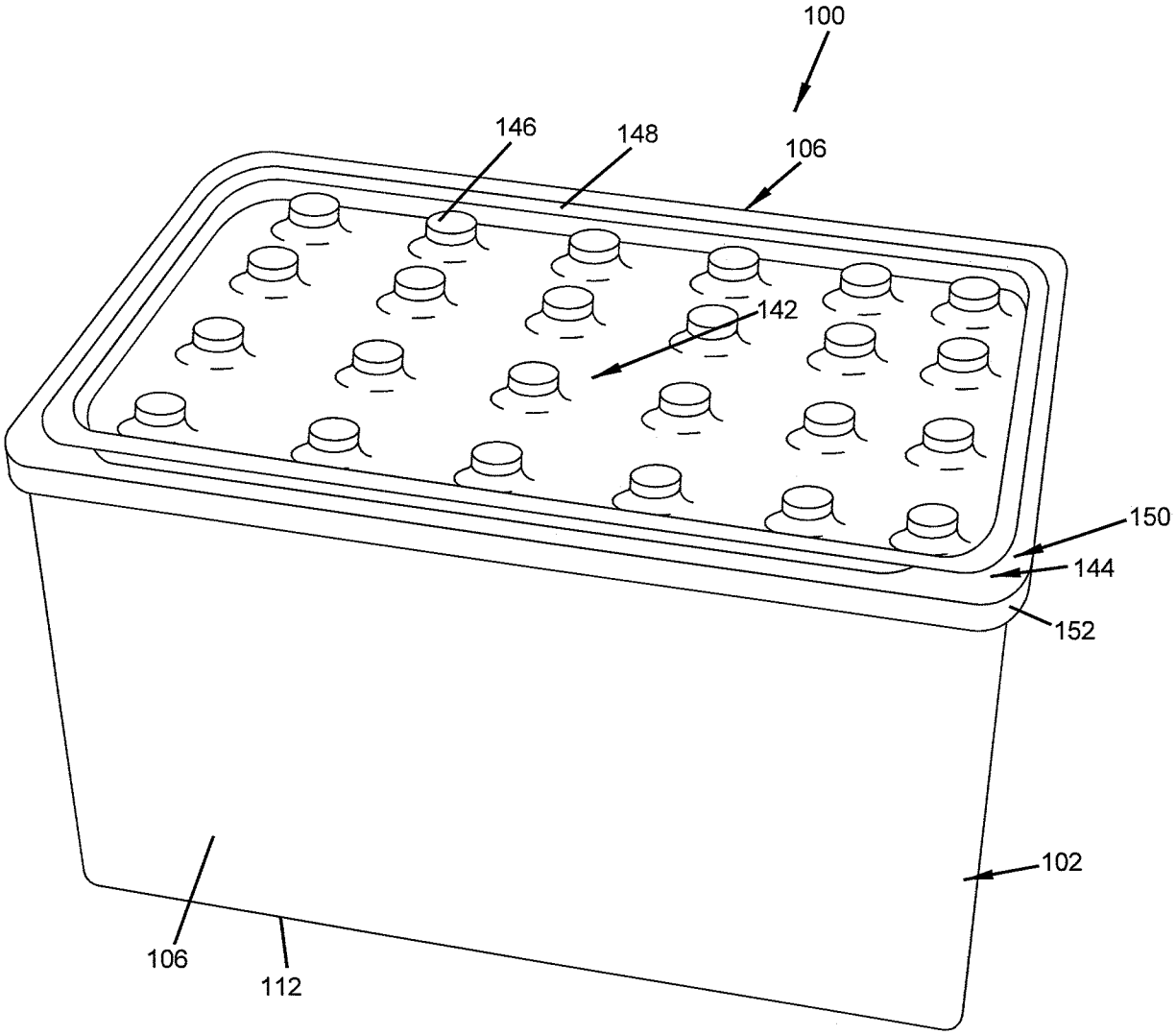
FIG. 1 is a perspective view of a secondary packaging system according to one embodiment.
Figure 2:
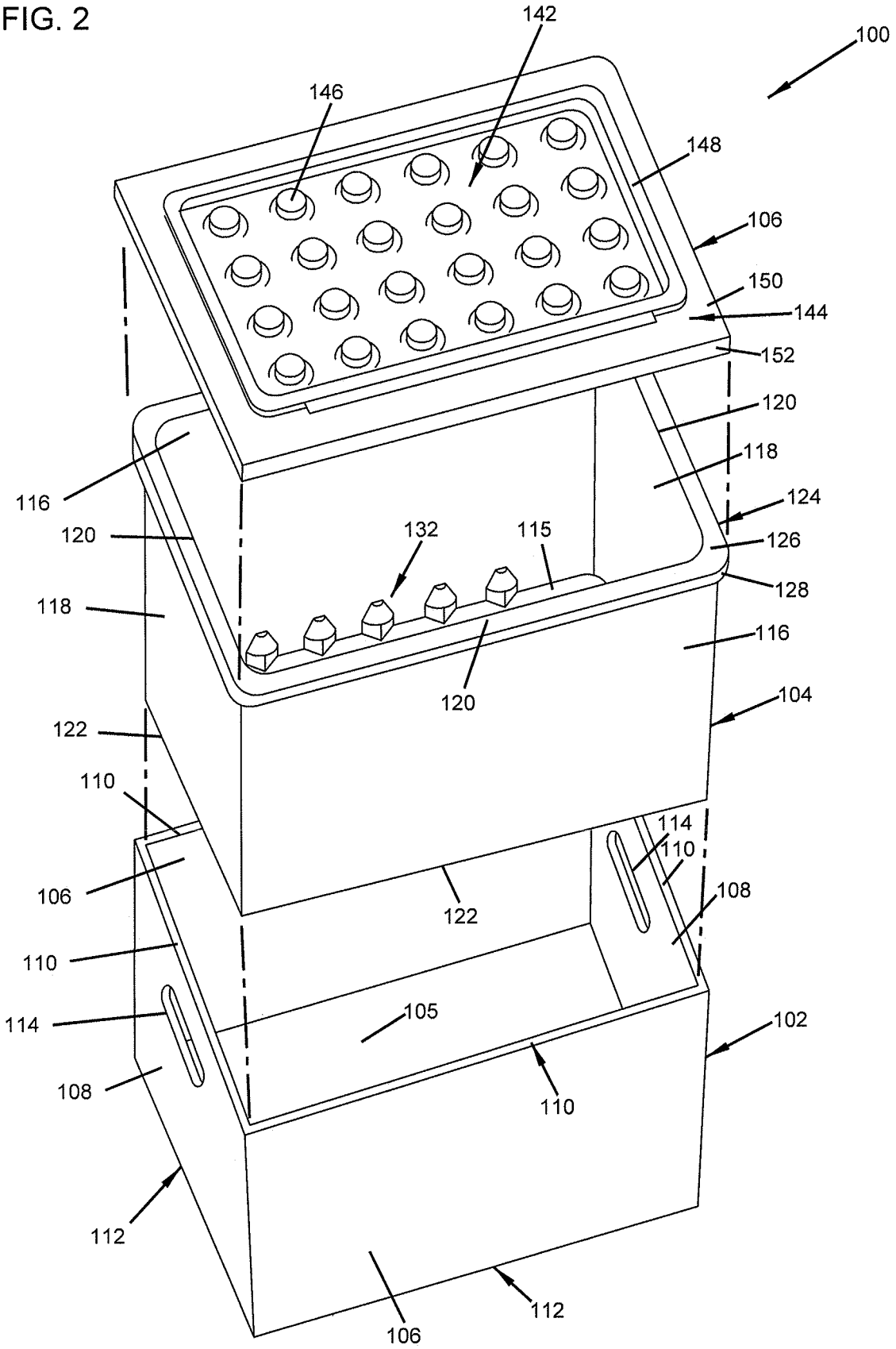
FIG. 2 is an exploded view of the secondary packaging system of FIG. 1.

With reference now to the drawings, a more detailed description of the secondary packaging may be provided. A secondary packaging system 100 is shown in FIG. 1 and an exploded view thereof is shown in FIG. 2. As shown, the secondary packaging system 100 may be in the form of a case including a carton or box 102, a liner 104 situated within the carton or box, and a lid 106 for opening and closing the case. The secondary packaging system 100 may also be in the form of a crate, basket, bag, sack, or bin. Other collecting-type devices may also be used. While these other types of secondary packaging systems 100 are within the scope of the secondary packaging system term, for purposes of discussion, the secondary packaging system 100 will be referred to as a case 100. It is also noted that the secondary packaging system 100 may be the same or similar to the sustainable packaging system described in U.S. patent application Ser. No. 12/767,981 filed on Apr. 27, 2010 and entitled Sustainable Packaging System for Shipping Liquid or Viscous Products, the contents of which are hereby incorporated herein by reference in their entirety.

Each of the parts of the case 100 may now be described in detail. Beginning with the carton or box 102, and with continued reference to FIG. 2, the box 102 may be generally rectangular, although other shapes may also be provided. The box 102 may include a wall panel portion, a closed bottom 105, and an open top. While several box shapes may be provided, in the case of a rectangular box, the wall panel portion may include two box side wall panels 106 and two box end wall panels 108 alternately arranged end to end to form a rectangular box. The box side wall and end wall panels 106, 108 may each have a first or top edge 110 together forming a periphery of a top opening of the box 102. The box side wall and end wall panels 106, 108 may also each have a second or bottom edge 112 together forming a periphery of a bottom opening of the box 102.

The bottom 105 may be closed by a solid panel or it may be closed by flaps extending from one or more of the box side wall or end wall panels 106, 108. For example, a flap extending from the bottom edge 112 of each of the box side walls and end walls 106, 108 may be provided and may be foldable relative to its respective box side wall and end wall 106, 108. The flap may extend all or a portion of the distance across the bottom 105 of the box 102. In some embodiments, a single flap may be provided and may extend all the way across the bottom 105 of the box 102. In other embodiments, two flaps may be provided and may also extend all the way across the bottom 105, or they may extend only half way across. Other flap arrangements such as, for example, four flaps for closing the bottom 105 of the box 102 may be provided. In still other embodiments, the bottom 105 of the box 102 may be omitted providing for an open bottom 105 of the box 102.

The box 102 may be a conventional cardboard box constructed of, for instance, corrugated cardboard that may be 100% recyclable and/or bio-degradable. Other relatively light and/or recyclable materials may also be used for the box. For example, paperboard, plastic, or pressed board materials may also be used. The box 102 may also include other features such as hand holds 114 positioned in the box end wall panels 108 and configured for carrying the case 100. In some embodiments, the box 102 may be sized to accommodate 24 bottles arranged in a 4×6 array and having a height of approximately 9" and a diameter of approximately 2.5". As such, the box 102 may have a width of approximately 10", a length of approximately 15", and a height of approximately 9". Other sized boxes may be provided and may be selected based on the number and size of the pre-packaged products being packaged.

With continued reference to FIG. 2, the liner 104 may substantially conform to the inside of the carton or box 102 or at least be sized to fit within the box 102. The liner 104 may have a cross-sectional shape similar to the box 102, e.g., square or rectangular cross-sectional shape. Alternatively, the liner 104 may have any other shape, such as, but not limited to an oval or round cylindrical shape. In any of these instances, the cross-sectional shape of the liner 104 may be sized to fit within the box 102. For example, where a round cross-sectional shape is provided, the diameter of the liner 104 may be less than the least plan dimension of the box 102.

The liner 104 shown has a substantially rectangular cross-sectional configuration and, like the box 102, may include a wall panel portion, a closed bottom 115, and an open top. The wall panel portion may include two liner side wall panels 116 substantially similar in shape and size to the box side wall panels 106 and two liner end wall panels 118 substantially similar in shape and size to the box end wall panels 108. The liner side and end wall panels 116, 118 may have upper 120 and lower ends 122 defining a respective upper periphery of the open top and lower periphery of the closed bottom. The closed bottom 115 may include a liner bottom panel 119 substantially similar in shape and size to the box bottom 105. Accordingly, with the liner panels 116, 118, 119 substantially similar in size and arrangement to the box 102, when the liner 104 is placed inside the box 102, each of the liner panels 116, 118, 119 may be positioned immediately adjacent and inside a respective box panel. The liner panels 116, 118, 119 may be slightly smaller than the box panels to permit the liner 104 to fit inside the box 102 without the need to force the liner 104 into the box 102.

Aside from the top opening, the liner 104 may be a substantially continuous membranous type material free of perforations. The liner 104 may be made from a moisture resistant or waterproof material. In some embodiments, the liner may be made from plastic and may be relatively semi-rigid and thin, approximately in the range of about 0.008 inches to about 0.040 inches thick. However, it is recognized that the liner thickness could vary and could be outside the range of about 0.002 inches to about 0.015 inches, and in some embodiments, may depend on the desired use or application of the liner. Other materials including, but not limited to vinyl, rubber, or metal may also be used.

The liner 104 may be made by any means or combination thereof known in the art, such as, but not limited to vacuum forming, thermo forming, blow molding, injection molding, or stamping. The liner may be made, for example, of a 100% recyclable material, such as, but not limited to high-density polyethylene (HDPE) or linear low density polyethylene (LLDPE). The liner may also be made from a bio-degradable material. The liner may be self-supporting, but the relative thinness of the liner 104 may make the liner easily collapsible, which may reduce the volume and cost of disposal or recycling.

The liner 104 may include a rim 124 extending around the top opening of the liner 104 configured to engage the periphery of the top opening of the box 102. The rim 124 may include a flange portion 126 and a depending skirt portion 128. The rim 124 may extend fully around the upper periphery of the liner 104, being an integral extension of the upper end 120 of the liner side wall 116 and liner end wall panels 118. In another embodiment, the rim 124 may extend partly around the upper periphery of the liner 104. When the liner 104 is placed in the box 102, the top edge 110 of the box side 106 and box end 108 walls may be positioned underneath the rim 124 of the liner 104 as can be seen in FIG. 3, with the top edge 110 of the box side wall panels 106 and box end wall panels 108 between the respective liner side wall panel 116 or liner end wall panel 118 and the skirt portion 128.

Figure 3:
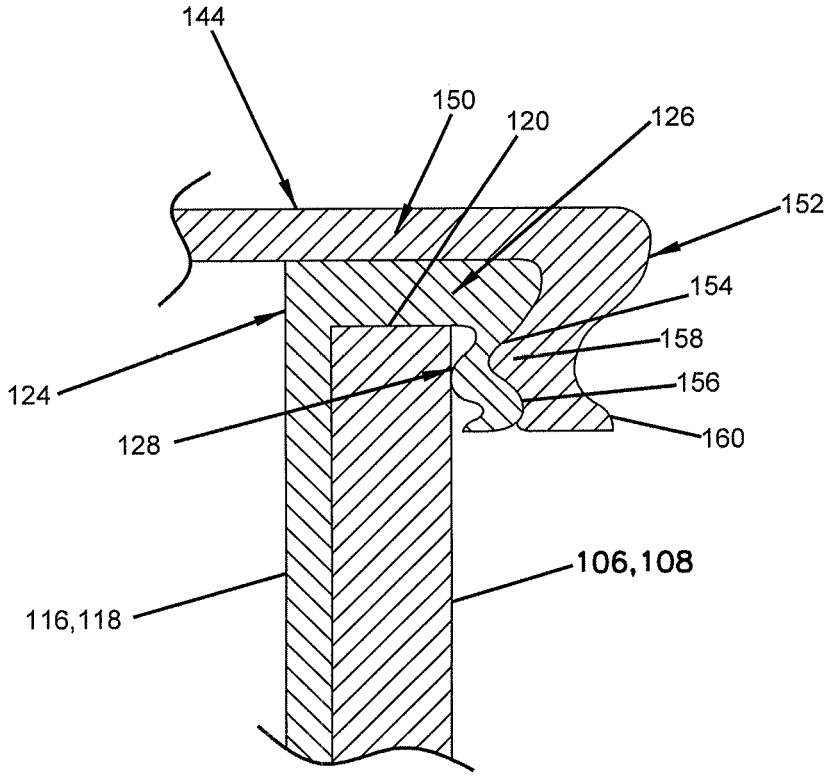
FIG. 3 is a cross-section view of the rim of the secondary packaging system of FIG. 1.

As shown in FIG. 3, the flange portion 126 may extend from the top opening of the liner 104 and across the top edge 110 of each of the box side and box end wall panels 106, 108. The length of the flange portion 126 may be generally consistent around the top opening of the liner 104 where the cross-sectional shape of the liner 104 is similar to the cross-sectional shape of the box 102. Where the cross-sections differ, the length of the flange portion 126 of the rim 124 may vary and may be longer where a liner side or liner end wall panel 116, 118 diverges from a respective box side or box end wall panel 106, 108. For example, where the liner side and liner end wall panels 116, 118 intersect to form a corner, a radiused corner may be provided in the liner 104. When positioned in a box 102 with a more rectangular corner, the liner walls 116, 118 may diverge from the box walls 106, 108 causing a gap between the liner panels 116, 118 and the walls 106, 108. The flange 126 of the rim 124 may have a longer length to reach the outside surface of the box walls 106, 108. In some embodiments, the transition between the flange and the liner side wall or end wall 116, 118 may be chamfered or radiused. In some embodiments, this chamfer or radius may be more pronounced near the corners of the carton or box and may be a three dimensionally shaped. That is a concave bowl or funnel may be provided below the liner lip that may help guide cylindrical containers into the corner pocket. In both the sidewall and corner situations, the chamfer or radiused inner edge of the flange may allow for guiding bottles, cans, or other products into the liner and/or case.

The skirt portion 128 may extend down from the flange portion 126 along the outside face of each of the box side and box end wall panels 106, 108. The skirt portion 128 of the rim 124 may include an interlocking engagement feature 130 for engagement by the lid 106. The engagement feature 130 may include a rib or recess extending circumferentially around the rim 124 of the liner 104 for engagement by a respective recess or rib on the lid 106.

Figure 4:
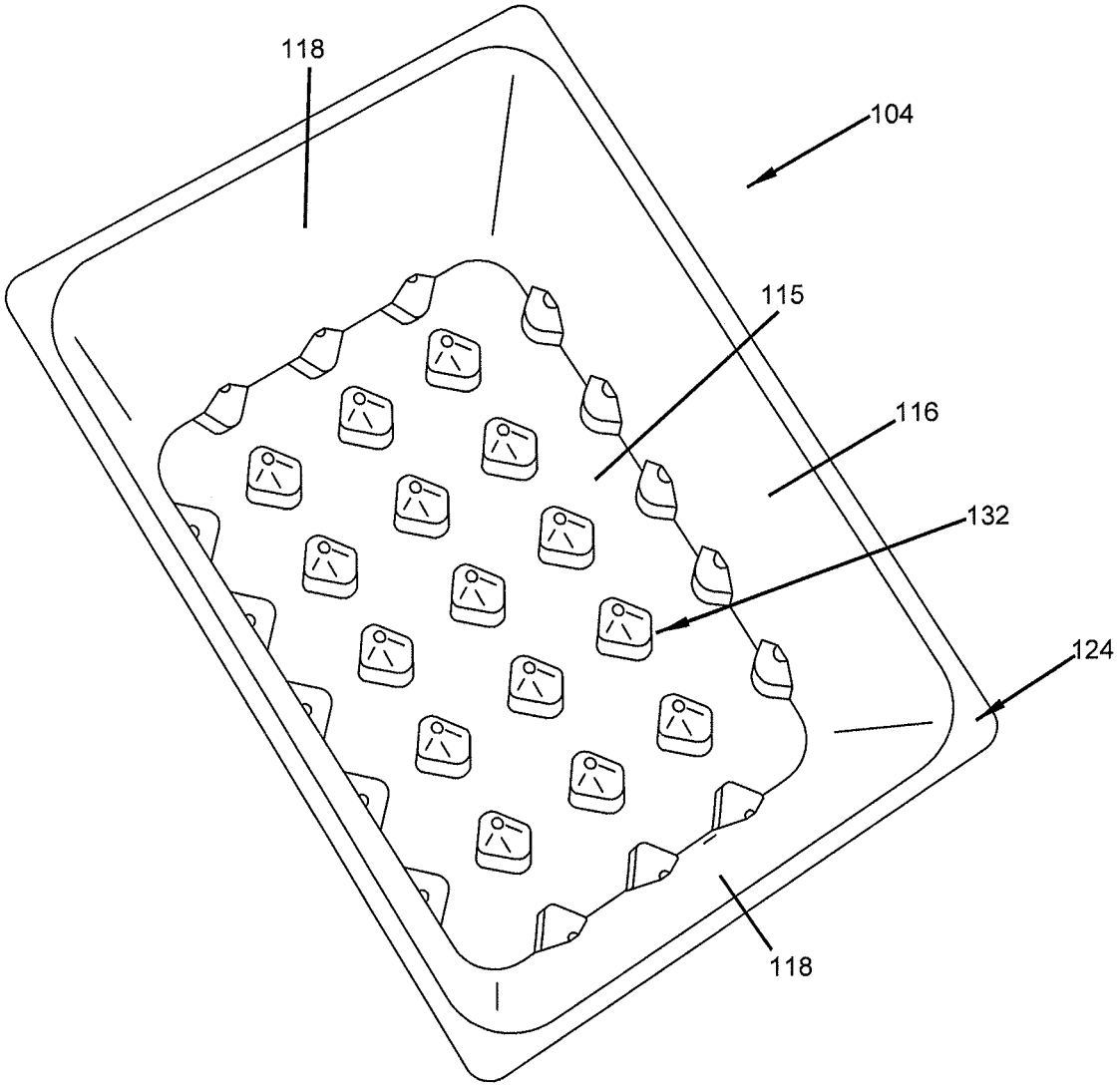
FIG. 4 is a top perspective view of a liner of the secondary packaging system of FIG. 1.
Figure 5:
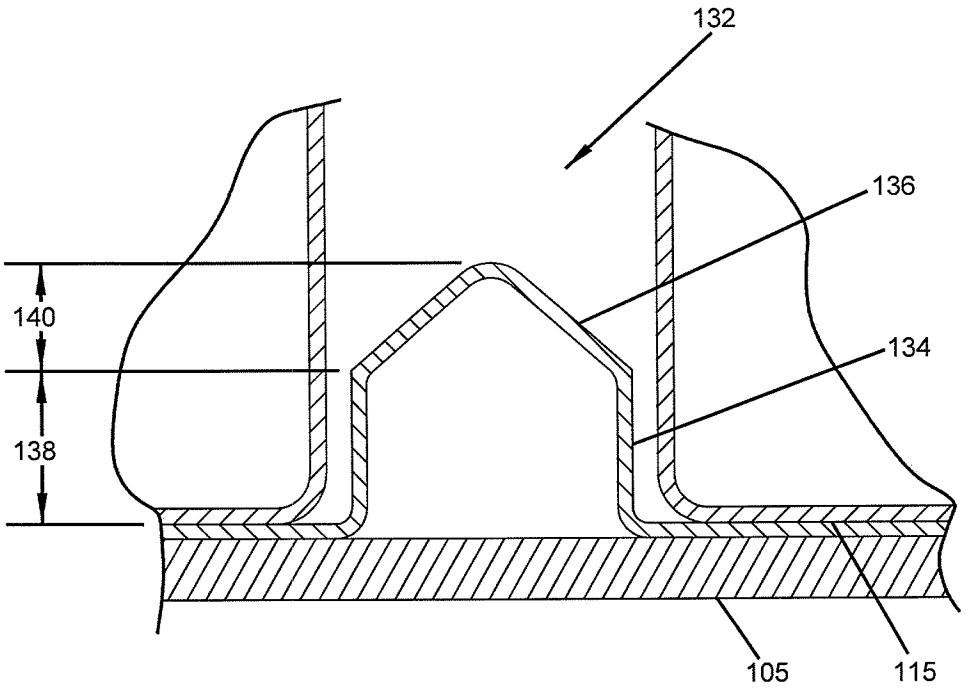
FIG. 5 is a cross-section view of a positioning feature of a liner of the secondary packaging system of FIG. 1.

Referring now to FIGS. 4 and 5, the liner 104 may also include positioning features 132. The positioning features 132 may be arranged on the bottom 115 of the liner 104 and may be configured to maintain the position of bottles or other products packaged in the case 100. The positioning features 132 may be designed and positioned to maintain the product positions as a whole or may be designed and positioned to maintain each product position within the case 100. The positioning features 132 may include spacers or dividers in the form of recesses, protrusions, troughs, fences, pockets, or other location defining elements adapted to prevent or reduce motion of the products relative to the case 100 and/or relative motion between the products. The positioning features 132 may be separate elements that are added into or onto the liner 104 or they may be molded or otherwise formed with the liner 104. In addition, the positioning features 132 may be shaped to accommodate the shape of the product being packaged. Additional examples of positioning features may include lumps, blobs, balls, or other protrusions of foam or other dunnage type materials. In other examples, the positioning features may be sleeves shaped to receive the pre-packaged products. In still other examples, a cardboard grid or other dividing or fence-like element or elements may be provided.

As shown in FIG. 4, the positioning features 132 may include protrusions extending upward from the bottom of the liner 104. The protrusions shown are arranged to fill void spaces between bottles arranged in a 4×6 array. As shown best in the cross-section of FIG. 5, the protrusions may have a bumper portion 134 and a packing guide portion 136. The bumper portion 134 may have a generally rectangular or square plan view shape. Other shaped protrusions may also be provided depending on the shape of the product being packaged and the void space to be taken up. The square portion may extend upward from the bottom 115 of the liner 104 defining the height 138 of the bumper portion 134. The height 138 of the bumper portion 134 may range from approximately ⅛" to approximately 4". In other embodiments, the bumper height 138 may range from approximately ¼" to approximately 2". In still other embodiments the bumper height 138 may range from approximately ⅜" to approximately 1". Other bumper heights 138 outside the ranges described may also be used. The bumper portion 134 may have plan dimensions based on the number of products being packaged, the amount of space within the case 100, and the arrangement of the products. Where fewer products are being packaged, more space may be taken up by providing larger protrusions. The plan dimensions, e.g., the width and length, of the bumper portion 134 of the protrusion may range from approximately ½" to approximately 2". In other embodiments, the plan dimensions may range from approximately ¾" to approximately 1½". In still other embodiments, the plan dimensions may be approximately 1". Other plan dimensions outside the ranges mentioned may also be provided. The packing guide portion 136 may extend upward from the bumper portion 134 and may be configured to guide products into position around a plurality of protrusions. Accordingly, the packing guide portion 136 may include sloped, angled, or rounded surfaces arranged and oriented to redirect or guide the products into position between the protrusions. In the embodiment shown, the packing guide portion 136 of the protrusions includes a pyramidal shape extending upward from the bumper portion 134 and having a rounded apex. As such, when bottles or other products are placed the liner 104, the products may have a tendency to be guided away from the protrusions and down the slopes of the pyramidal guide portions such that the products fall between the protrusions. The plan dimension of the packing guide portion 136 may match the dimensions of the bumper portion 134 so as to smoothly extend therefrom. In other embodiments, the packing guide portion 136 may have a larger or smaller footprint than the bumper portion 134. The height 140 of the packing guide portion 136 may range from approximately ⅛" to approximately 4". In other embodiments, the height 140 may range from approximately ¼" to approximately 2". In still other embodiments the height 140 may range from approximately ⅜" to approximately 1". Other heights 140 outside the ranges mentioned may also be provided. For example, the protrusions, including the bumper portion 134 and the packing guide portion 136, may extend any height within the liner 104 to maintain the relative position of the packaged products in the liner 104. In some embodiments, the protrusions may extend the full height of the liner 104. In other embodiments, the protrusions may extend only partially along the height of the liner 104 to provide more space for ice, for example, to be positioned between the products.

Referring again to FIG. 4, the protrusions may be arranged on the bottom 115 of the liner 104 in a rectangular array. Other arrangements may also be provided depending on the desired arrangement of products in and around the protrusions and the shape of the products. In the liner 104 shown, the protrusions are arranged to accommodate a rectangular array of approximately 2½" diameter round bottles packaged in the liner 104. As such, the protrusions may each be oriented obliquely to the liner side walls 116 and liner end walls 118 so as to fill or substantially fill the scalloped-diamond-shaped void space at the center of each 2×2 rectangular array of bottles. At the perimeter of the liner 104, half protrusions may be provided to fill or substantially fill the void space between each 2×1 rectangular array of bottles and the liner wall 116, 118. At the corners of the liner 104, portions of protrusions may be provided or the liner wall 116, 118 may be radiused or otherwise modeled after the shape of the product to laterally support the product in the corner of the rectangular product array.

In other embodiments, the protrusions or other positioning features 132 may be limited to the periphery of the array of products and may be configured to maintain the products in position as a group rather than relative to one another. In this embodiment, a peripheral rack may be provided where protrusions extend along each liner side wall 116 and liner end wall 118 and are configured to abut the outer surfaces of the outer layer of products in the rectangular array and keep the array held together.

Referring again to FIG. 2, the lid 106 may be configured to cover the top opening of the liner 104 and the box 102. The lid 106 may therefore include a central portion 142 surrounded by a rim 144. Positioning features 146 may also be provided and may be configured to maintain a portion of the packaged product in place during shipping and handling. The lid 106 may also include a standoff rib 148 extending around the positioning features 146 and extending upwardly from the lid 106. The lid 106 may be placed on the liner 104 to close the case 100 and also to maintain the position of the products in the case 100.

The central portion 142 of the lid 106 may have a rectangular shape matching that of the liner 104. Other shapes may also be provided. The central portion 142 may be configured to extend across the full expanse of the top opening of the liner 104 and the box 102 and may be generally planar. The perimeter of the central portion 142 may be formed by a rim 144 including a flange 150 and a lip 152 depending therefrom. The flange 150 may be configured to oppose all or a portion of the flange 126 on the liner 104 and may have an outer periphery matching the outer periphery of the flange 126 on the liner 104. The lip 152 of the rim 144 may extend downward from the lid flange 150 and be configured to engage the skirt 128 of the liner 104.

As shown best in FIG. 3, for example, the skirt 128 of the liner 104 may extend downwardly and inwardly from the outer edge of the liner flange 126 to form a recess 154. The skirt 128 may then continue downwardly and slightly outward to form a flared portion 156 and the bottom edge of the skirt 128 may turn inward to form a hem or a hem may be omitted. Similarly, the lip 152 of the rim 144 may extend downwardly and inwardly from the lid flange 150 to form an inward extending rib 158 sized and dimensioned to engage the recess 154 of the skirt 128. The lip 152 may then extend further downward and outward to form a flared bottom edge 160. The lip 152 may also be hemmed or it may not be hemmed. Accordingly, when the lid 106 is positioned on the liner 104 and pressed to engage the liner 104, the lip 152 of the lid 106 may deflect outwardly allowing the rib 158 to pass beyond the outer perimeter edge of the flange 126 of the liner 104. Further pressing of the lid 106 may cause the rib 158 to engage the recess 154 and interlockingly engage the lid 106 with the liner 104. To remove the lid 106, the lid 106 may be pulled upward away from the liner 104 causing the lip 152 to deflect allowing the rib 158 to escape the recess 154 of the skirt 128 and pass by the periphery of the flange 126 freeing the lid 106 from the liner 104.

Alternative interlocking features for the skirt 128 and the lip 152 of the lid 106 may also be provided. For example, the skirt 128 may include a rib in lieu of a recess and the lip 152 of the lid 106 may include a recess in lieu of a rib. Other perimeter engagement systems may also be provided including button flaps or straps similar to that found on a cooler lid.

In some embodiments, the lid 106 may be hinged or otherwise secured to the liner 104 allowing the lid 106 to be opened without separating from the liner 104. In some embodiments, the lid 106 may be hinged on one side and have interlocking features or other securing features on one or more of the remaining sides. In some embodiments, the hinge may be a living hinge where the lid 106 is integral with the liner 104 and the hinge is formed by a creased, pressed, perforated, thinned, or otherwise weakened portion between the liner 104 and the lid 106. In other embodiments, the lid 106 may be secured to the liner 104 along one side of the liner 104 allowing for pivoting motion of the lid 106 about that side. For example, a flange 126 as described above may be provided on the liner 104 and a lid flange 150 may be provided on the lid 106. The lid flange 150 may be arranged adjacent to the liner flange 126 and may be secured to the liner flange 126 along one side of the liner 104. The flanges 126, 150 may be provided on all sides, a portion of the sides, or they may be limited to the side of the liner where the hinge is located.

Figure 8A:
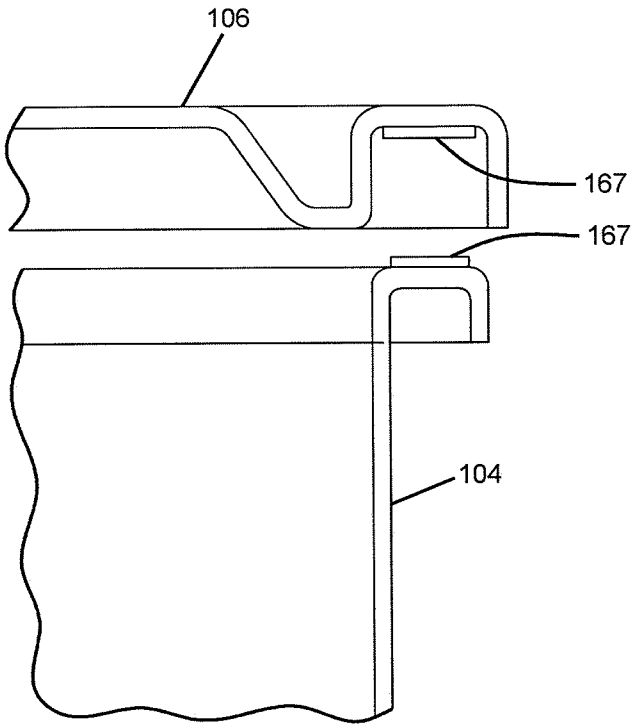
FIG. 8 is a perspective and cross-sectional view of a lid fused to a liner.
Figure 8:
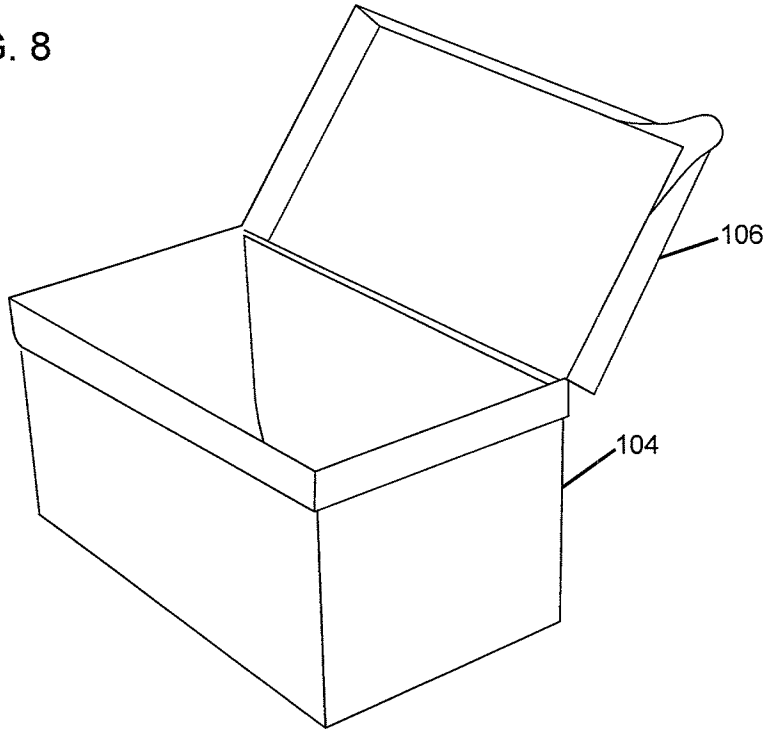
Figure 9A:
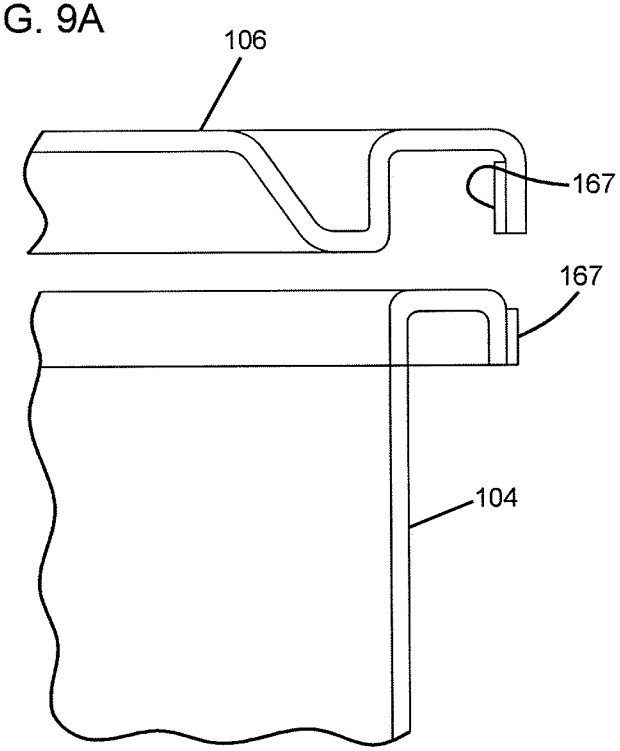
FIG. 9 is a perspective and cross-sectional view of a lid fused to a liner.
Figure 9:
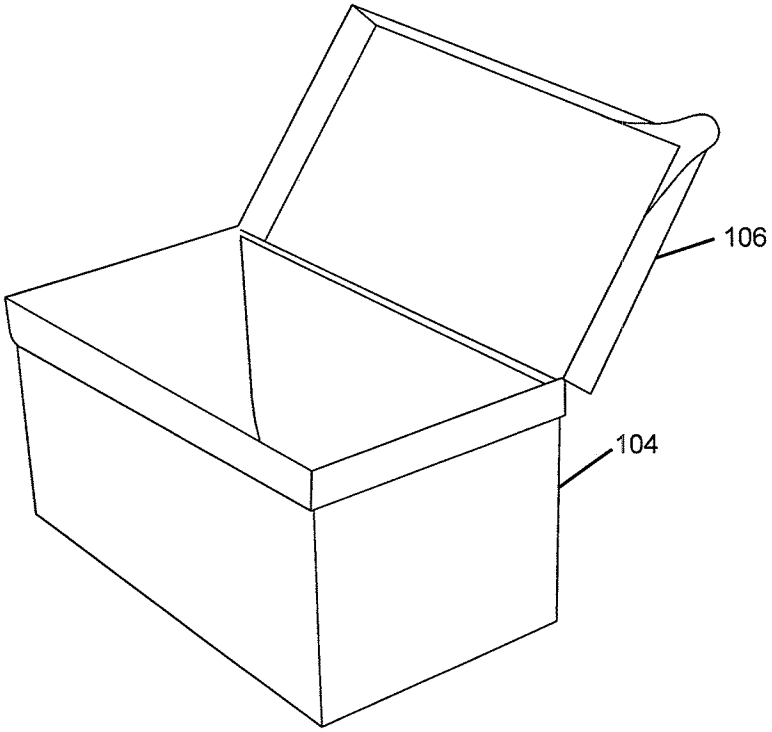
Figure 10A:
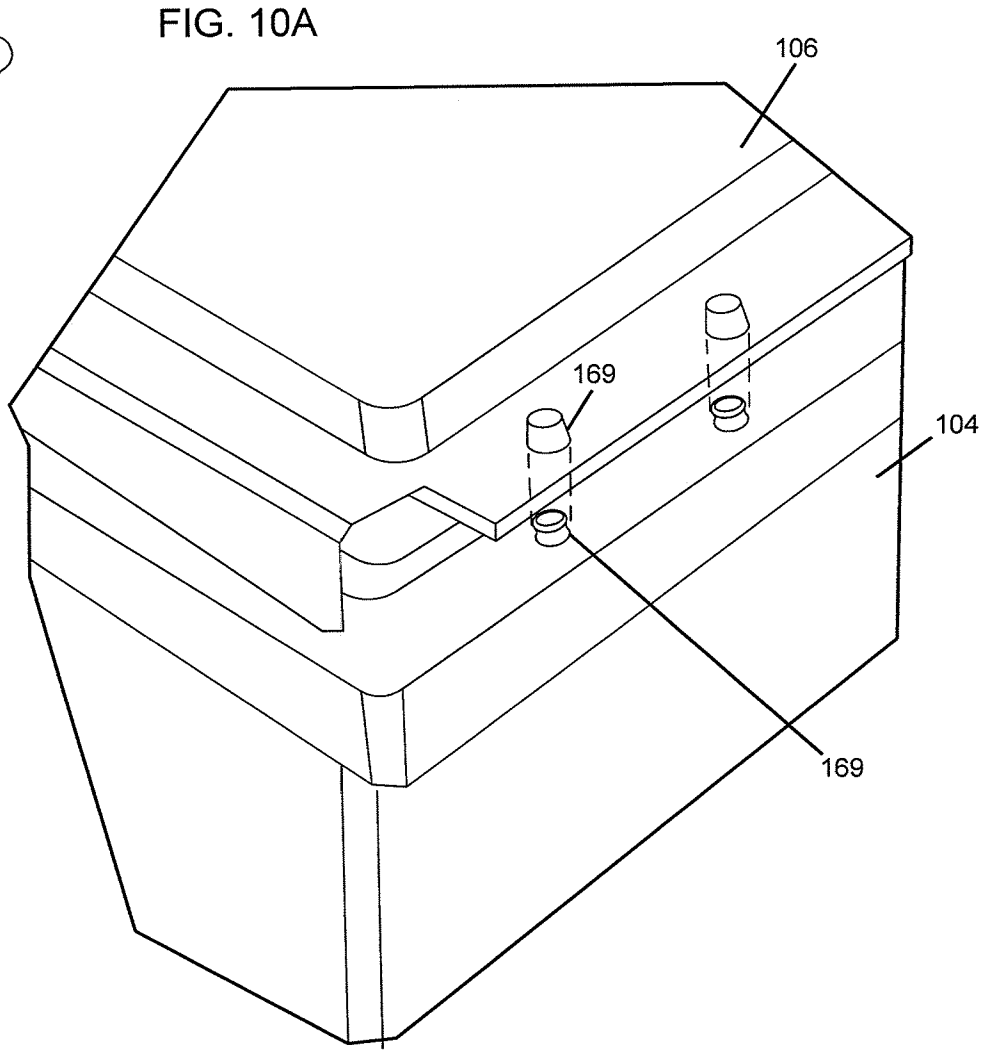
FIG. 10 is a perspective and close-up view of a lid mechanically secured to a liner.
Figure 10:
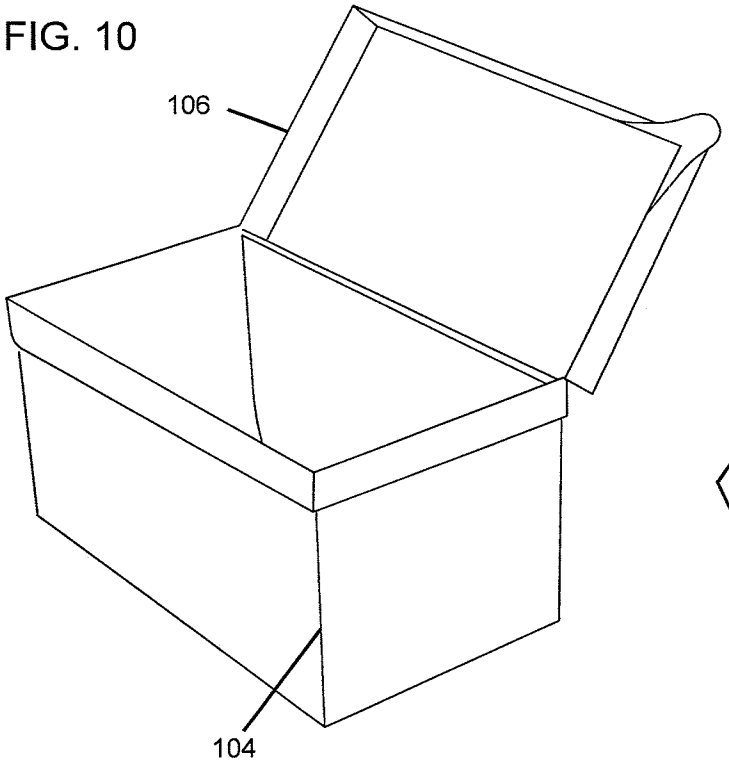
Figure 11:
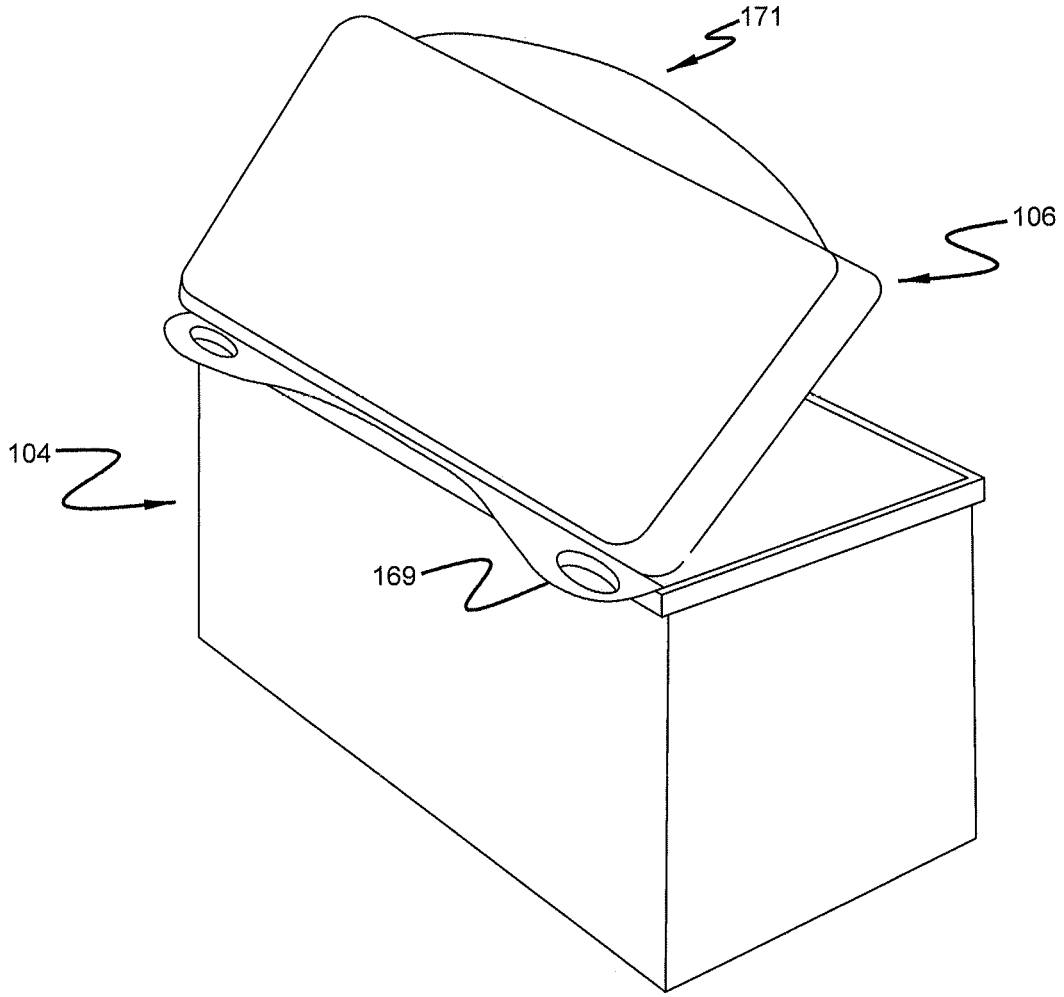
FIG. 11 is a perspective and cross-sectional view of a lid secured to a liner.
Figure 12:
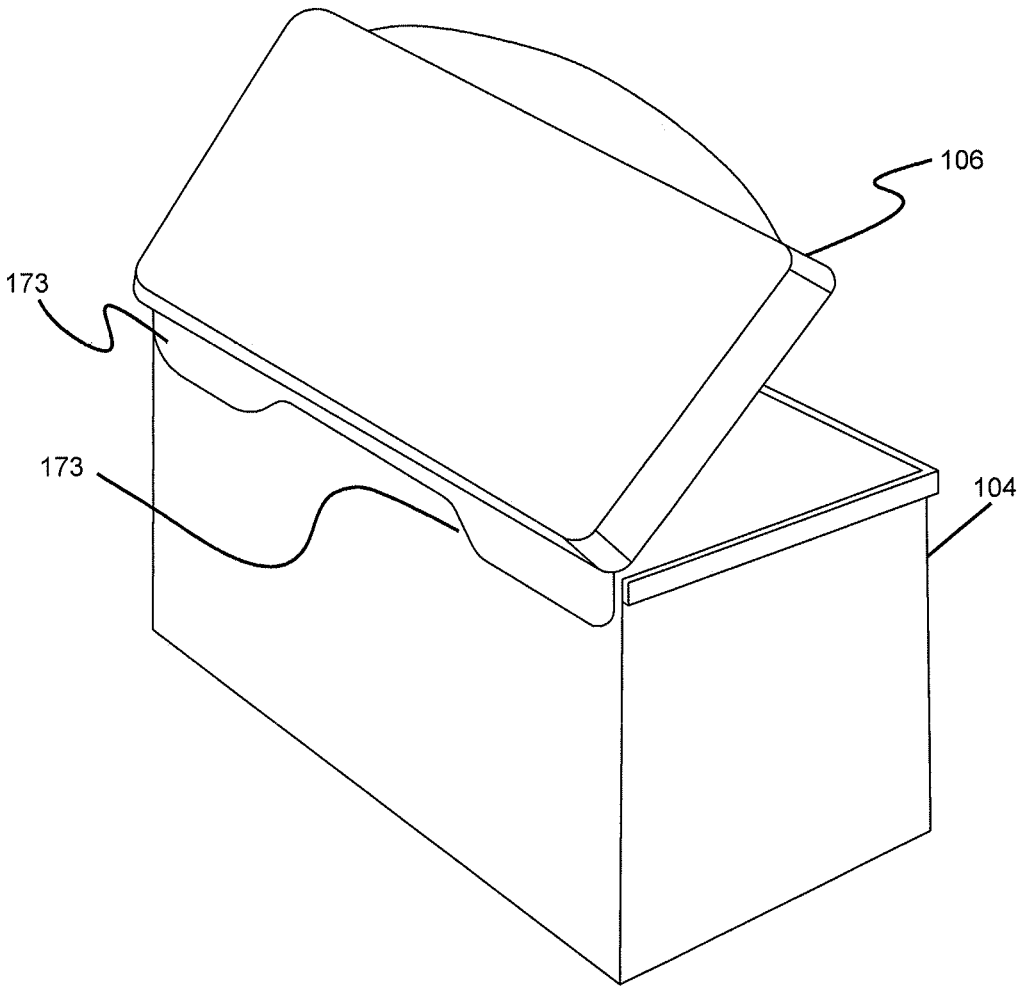
FIG. 12 is a perspective view of a lid secured to a liner with tabs.

The lid 106 may be secured to the liner 104 by fusing 167 or otherwise sealing the adjacent flanges together. For example, as shown in FIGS. 8 and 9, in some embodiments, the lid 106 may be secured to the liner 104 with a hot bar method to fuse the portions together. In FIG. 8, for example, the lid flange 150 and liner flange 126 may extend across the edge of a sidewall of the box and a hot bar may be press against the lid flange 126 and liner flange 150 using the box edge to hold the flanges in place and, thus, fusing them together. In still other embodiments, the flanges may be secured to one another with an impulse type seal or an adhesive system. In some embodiments, a hot-melt bead may be extruded into the liner or lid, or both, along a side to be hinged and the hot-melt bead may be heated to secure the lid 106 to the liner 104. In still other embodiments, a mechanical fastener 169 such as that shown in FIG. 10 or FIG. 11 may be used. As shown, one or more corresponding buttons may be arranged on the opposing flanges or other surfaces and may be pressed together to create a hinged lid. In other embodiments, the mechanical fastener may be a plastic rivot, tab and slot, a loop, crimp sleeve, or other mechanical type fastener. As shown in FIG. 11, a lifting handle or tab 171 may be also be provided opposite the hinged side of the system. In still other embodiments, as shown in FIG. 12, the lid may be fastened to the liner or carton with overlapping flaps 173 that may be adhered or otherwise secured to the liner or carton. In still other embodiments, a mechanical lock mechanism may be provided to secure the lid to the liner. For example, an arrow pointed tab may extend from either of the lid or the liner. The opposing portion of the liner or lid, respectively, may include a slit for insertion of the arrow pointed tab. The two may be pressed together and the arrow portion may wedge the slit open to allow passage therethrough of the tab. Once through the slit, the slit may return against the narrower portion of the tab below the arrow portion and the tab may be locked in the slit due to the abutment of the broad arrow portion against the opposite side of the material. Other mechanical-type fastening systems may be provided.

Figure 13A:
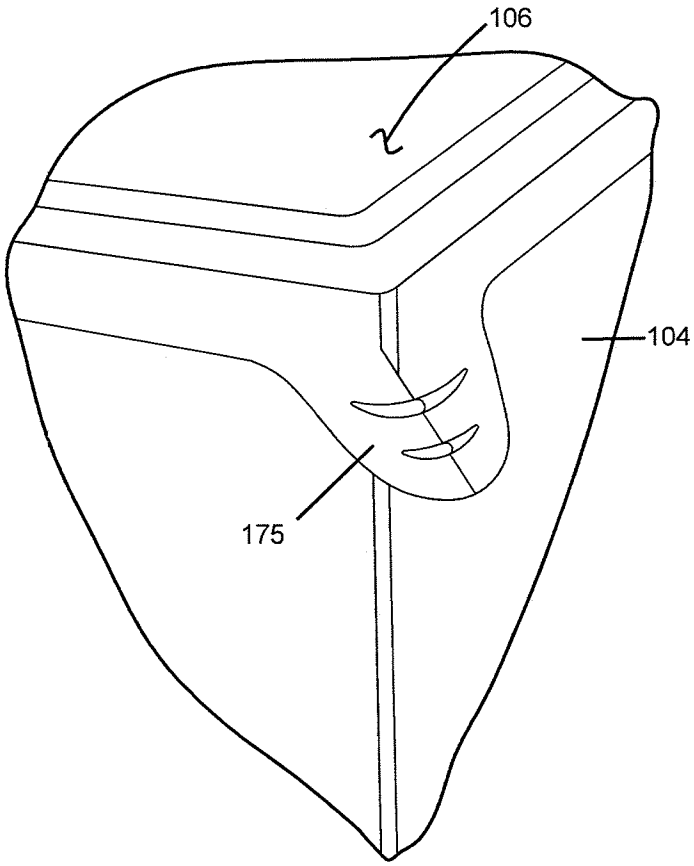
FIG. 13 is two perspective views of a tab on a lid overlapping a carton or liner.
Figure 13:
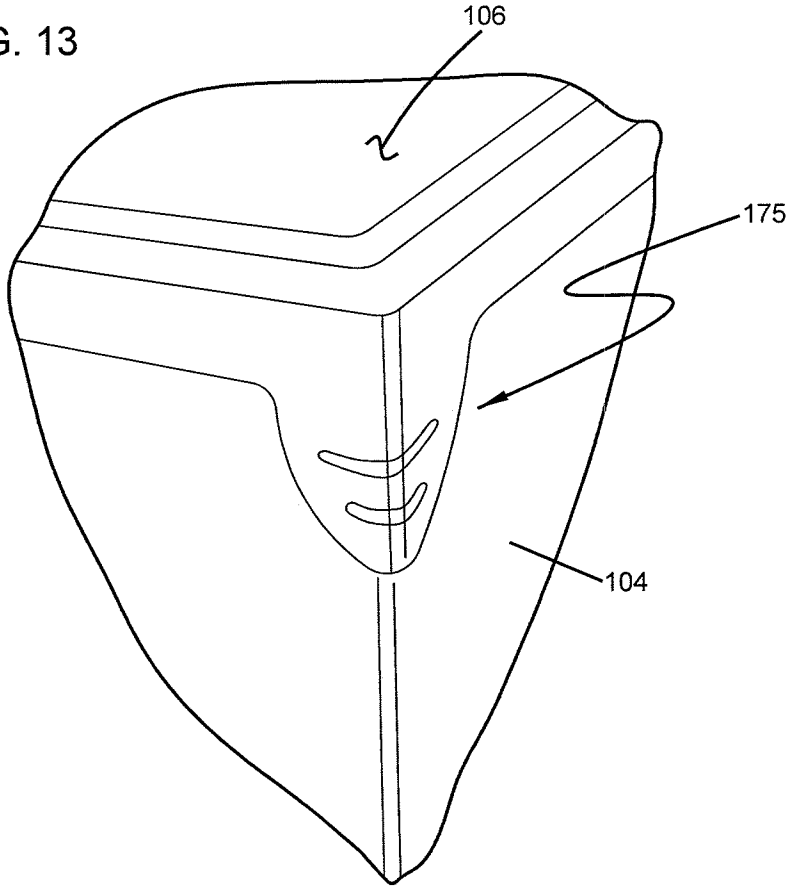

While described as a hinge, the several systems described above for forming a hinge may be provided on one or more sides of the liner 104 and may provide for securing the lid 106 in a closed position until opening of the lid 106 is desired, for example, by the end user. Accordingly, limited amounts or full amounts of securing devices may be provided on sides of the liner 104 in addition to the hinge side. The devices provided may be breakable to allow the lid 106 to open or perforations may be provided around the devices allowing the lid 106 to be pulled free from the devices and allow the lid 106 to open. In some embodiment, the securing devices may provide for tamper protection and evidence of tampering where the devices are breached prior to arrival at the end user. In some embodiments, the securing devices may be provided on a tab 175, as shown in FIG. 13 for example, extending from the lid 106 and overlapping onto the liner 104. The tab may be embossed or textured and may be arranged to flex downward along the side of the liner 104 so as not to interfere with transport and handling. The tab may include branding information via the embossing or a label. The tab, like the securing devices described above may provide for tamper protection or evidence of tampering where the tab is torn or otherwise reveals that the lid 106 may have been opened prior to reaching the end user. In still other embodiments, a label may be secured to the tab and the liner 104 and the label may serve as tamper protection. That is, where the label is torn or removed, this may reflect that the lid 106 has been opened or could have been opened.

Figure 14:
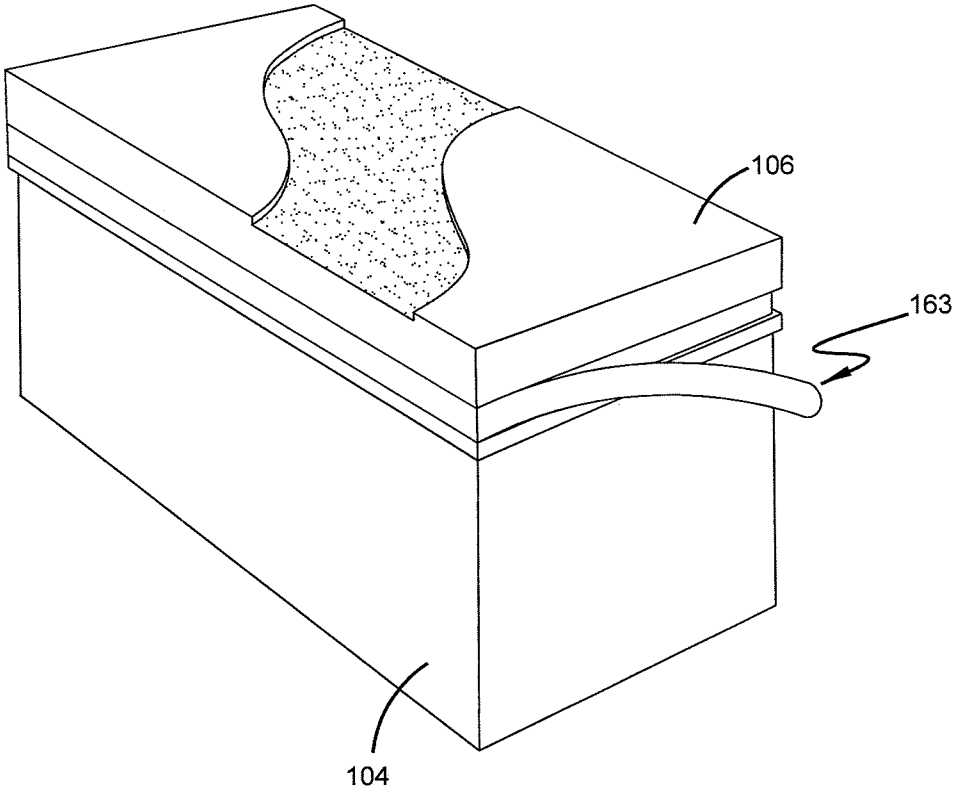
FIG. 14 is a perspective view of a pull tab for securing and releasing a lid.

Other perimeter engagement systems may include adhered flaps extending down the side of the box 102. Still other perimeter engagement systems may include pull strip or zip strip 163 allowing some or all of the sides of the lid to be released from the liner. For example, as shown in FIG. 14, a pull tab may be provided secured to a strip that, when pulled, tracks along the seam between the lid and liner to release the lid from the liner. For example, perforations or other weakening techniques may be used to cause the strip to track along the seam between the lid and liner. Still other perimeter engagement systems may include a toothed slot slidable over the liner wall 116, 118 and box wall 106, 108. Other perimeter engagement systems may also be provided and may extend around the full periphery of the case 100 or partially around the periphery of the case 100. Combinations of the above systems may also be used.

Figure 15A:
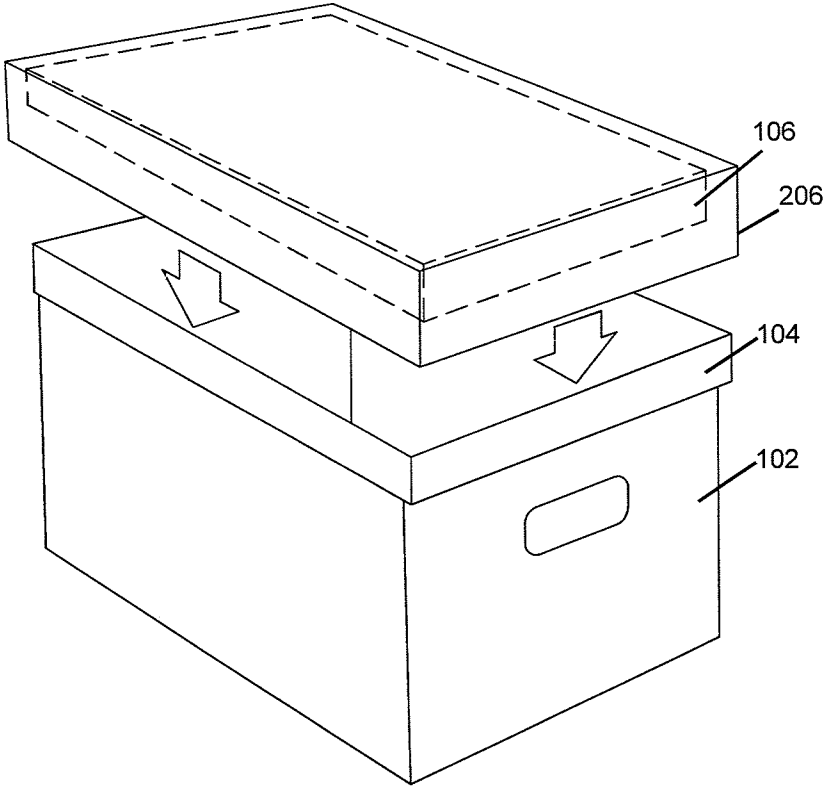
FIG. 15 is two perspective views of a box with a liner wherein one box/liner has only a shoebox-type box lid and the other box/liner has a shoe-box type box lid and a liner lid arranged within the box lid.
Figure 15:
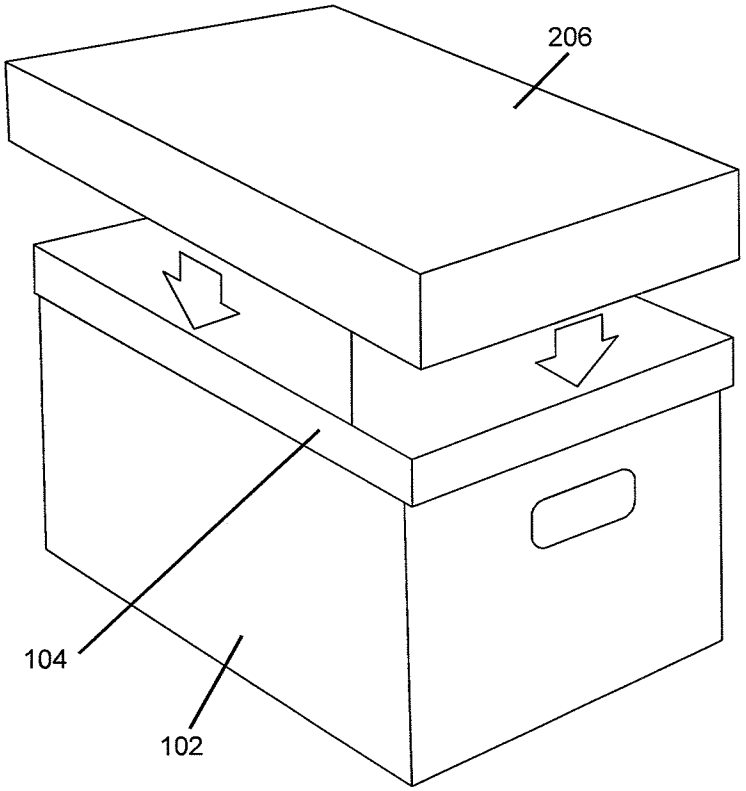

In still other embodiments, the lid may be freely removable and a hinge may not be provided. As shown in FIG. 15, a shoe box type lid 106 may be used. In one embodiment, as shown, the shoe box lid may include a cardboard or corrugated material lid 206 that may be positioned over the box 102 and the liner 104. In other embodiments, a corresponding liner lid 106 may also be included for arrangement within the cardboard shoe box lid 206 and positioning over the perimeter of the liner 104. In still other embodiments, a liner material lid 106 may be provided similar to the lid shown in FIGS. 1-8 and a cardboard lid 206 may be omitted.

With reference again to the embodiment of FIGS. 1-8, the liner flange 126 and skirt 128 together with the lid flange 150 and lip 152 may form an overhanging standoff bumper that may function to provide impact resistance as well as space between cases 100 to prevent rubbing and abrasion of boxes 102 and may protect labeling or otherwise prevent wear.

The positioning features 146 of the lid 106 may, like the positioning features 132 of the liner 104, be configured to maintain the position of bottles or other products packaged in the case 100. The positioning features 146 may be designed and positioned to maintain the product positions as a whole or may be designed and positioned to maintain each product position within the case 100. The positioning features 146 may include spacers or dividers in the form of recesses, protrusions, troughs, fences, pockets, or other location defining elements adapted to prevent or reduce motion of the products relative to the case 100 and/or relative motion between the products. The positioning features 146 may be separate elements that are added into or onto the lid 106 or they may be molded or otherwise formed with the lid 106 and they may be shaped to accommodate the shape of the product being packaged.

Figure 6:
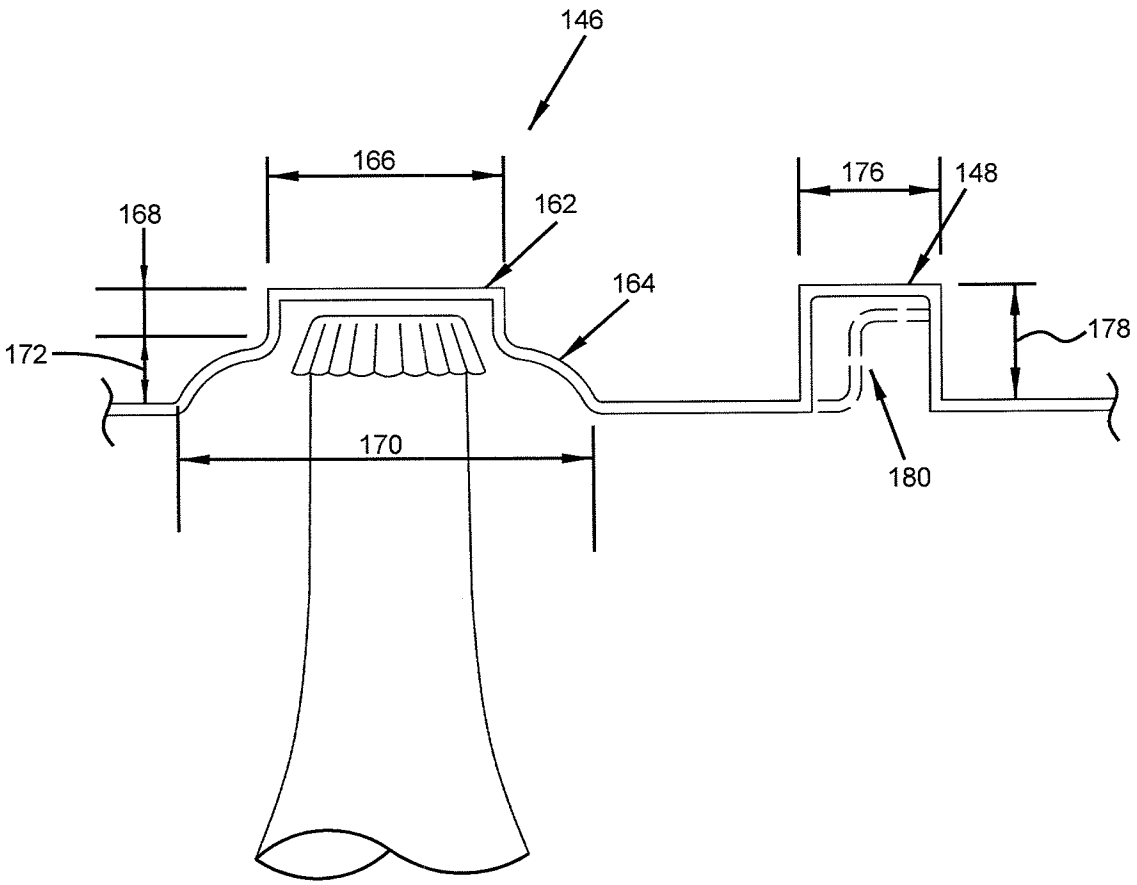
FIG. 6 is a cross-section view of a standoff and a positioning feature of a lid of the secondary packaging system of FIG. 1.
Figure 7:
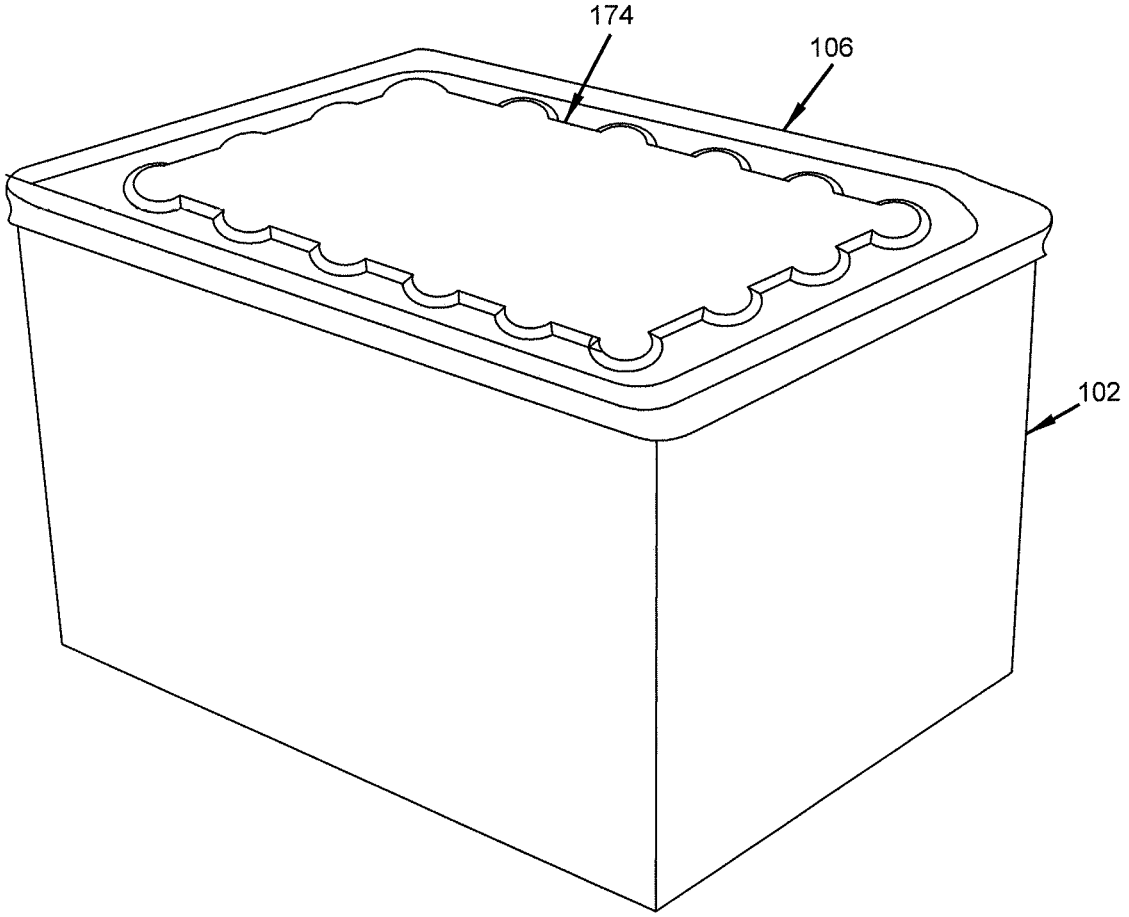
FIG. 7 is a perspective view of a secondary packaging system according to another embodiment.

As shown in FIGS. 1 and 2, the positioning features 146 may include protrusions extending upward from the lid 106 providing a recess on the bottom of the lid 106. In contrast to the protrusions described with respect to the liner 104, these recess providing protrusions are arranged and configured to receive a portion of the packaged product and hold it in position relative to the lid 106 rather than take up void space between the packaged products. However, the opposite case may also be provided and the positioning features 146 on the lid may be provided to take up void space between the packaged products similar or the same as the features on the bottom of the liner. In the embodiment shown, where the positioning features receive, for example, the top of a bottle, while protrusions are seen extending from the top of the lid 106, the positioning features 146 shown will be described as recesses formed in the bottom of the lid 106. As best shown in FIG. 6, the recesses may include a holding portion 162 and a lid guiding portion 164. The holding portion 162 of the recess, like the bumper portion 134 of the protrusion on the liner 104, may be configured to maintain or control the position of the product. The lid guiding portion 164, like the packing guide portion 136 on the liner 104, may be configured to guide the lid 106 such that the packaged items are aligned with the holding portion 162 allowing the lid 106 to be secured to the rim 124 of the liner 104.

The holding portion 162 of the recess may be adapted to receive, for example, a top of a bottle and may, thus, have a cylindrical shape. Other shapes may also be provided and may be selected based on the shape of the packaged items in the case 100. The cylindrical shape may have a diameter 166 slightly larger than that of the packaged bottles. The diameter 166 of the holding portion 162 may range from approximately ¼" to approximately 3". In other embodiments, the diameter 166 may range from approximately ½" to approximately 2". In still other embodiments, the diameter 166 may range from approximately ¾" to approximately 1½". Other diameters 166 outside the ranges provided may also be used. The cylindrical portion may have a height 168 ranging from approximately 1/16" to approximately 3". In other embodiments, the height 168 may range from approximately ⅛" to approximately 2". In other embodiments, the height 168 may range from approximately ¼" to approximately ½". Other heights 168 outside the ranges provided may also be used.

The lid guiding portion 164 may be adapted to receive, for example, a top of a bottle or other packaged item and cause the lid 106 or the bottle to shift and allow the top of the bottle or other packaged item to engage the holding portion 162 and further allow the lid 106 to be pressed onto the liner 104. As such, and like the packing guide portion 136 of the liner protrusions, the lid guiding portion 164 of the recess may include an angled, sloped, or curved portion to redirect the packaged product or lid 106 relative to one another allowing engagement of the packaged product with the holding portion 162.

In the embodiment shown, the lid guiding portion 164 includes a generally arcuate and concave depression extending upward from the bottom of the lid 106 and leading to the cylindrical holding portion 162. The arcuate and concave depression may have a generally circular plan view shape in keeping with the cylindrical holding portion 162. As with the holding portion 162, other plan view shapes may be provided and may be selected depending on the shape of the packaged product. The depression may have a diameter 170 at the lower surface of the lid ranging from approximately ½" to approximately 6". In other embodiments, the diameter 170 may range from approximately 1" to approximately 3". In other embodiments, the diameter 170 may range from approximately 1½" to approximately 2". Other diameters 170 outside the ranges mentioned may also be provided. The diameter 170 of the depression may decrease linearly (e.g., like a cone) or non-linearly (e.g., like the arcuate path shown) as the depression extends away from the lid 106 until the diameter of the depression matches that of the cylindrical holding portion 162. The depression may have a height 172 ranging from approximately ⅛" to approximately 4". In other embodiments, the height 172 may range from approximately ¼" to approximately 2". In still other embodiments the height 172 may range from approximately ⅜" to approximately 1". Other heights 172 outside the ranges mentioned may also be provided.

The positioning features 146 on the lid 106 may be arranged in a pattern to accommodate the pattern of arrangement of the packaged products. In the embodiment shown, the bottles in the case are arranged in a 4×6 rectangular array and the positioning features 146 are arranged in a matching array to receive the tops of the bottles. The positioning features 146 may function to both maintain the separation between the products in the case and hold the crown or portion near the lid in place. When provided together with positioning features 132 on the bottom of the liner, the positioning features together may create a case capable of maintaining the position of the products in the case thereby protecting against shifting and breakage of the products in the case where products may otherwise contact one another during shipping and handling.

It is noted that while the positioning features 132 shown and described with respect to the bottom of the liner 104 have been described as void space protrusions, and the positioning features 146 of the lid 106 have been described as recesses for receiving the top of the packaged product, the opposite may also be provided. That is, the liner 104 may include recesses for receiving products and the lid 106 may include void space protrusions arranged between the products. In still other embodiments, both the liner 104 and the lid 106 may include void space protrusions or product receiving recesses. In still other embodiments, both void space protrusions and recesses may be provided on the liner 104 or the lid 106 or both. In still further embodiments, the liner side walls 116 and/or end walls 118 may include product receiving recesses or void space protrusions or both.

In addition, and similar to the protrusion arrangements described with respect to the liner 104, the positioning features 146 on the lid 106 may be arranged to support the packaged products as a whole rather than individually. For example, as shown best in FIG. 7, the positioning feature 174 on the lid 106 may include a broadly extending recess when viewed from the bottom of the lid 106 that acts as a peripheral rack and has a boundary that encompasses the full footprint of the packaged bottles thereby bracing the outermost bottles in the array against motion relative to the case 100. It is noted that the standoff feature of FIGS. 1, 2, and 6 is not shown in FIG. 7, but may be provided together with this embodiment. However, as shown, the present positioning feature 174 is recessed into the top of the lid 106 thereby causing the top of the positioning feature 174 to be flush with the rim 144 of the lid 106 and the standoff may thus be omitted.

Continuing with the description of the lid, and with continued reference to FIG. 6, the standoff rib 148 may be positioned on the central portion 142 of the lid 106 or it may be positioned on the rim 144 of the lid 106 or it may define the transition there between and may be configured to facilitate removal of the lid 106 while also providing additional surface area for stacking of additional cases 100. As shown, the standoff 148 may be arranged in a rectangular shape surrounding the positioning features 146 of the lid 106. The standoff 148 may extend upwardly from the lid 106 and may have a cross-section in the shape of a rectangular or other shaped curb. The standoff 148 may have a cross-sectional width 176 ranging from approximately ⅛" to approximately 2" or a smaller range from approximately ¼" to approximately ¾" may be provided. Other cross-sectional widths 176 may also be provided. The standoff 148 may have a height 178 that is the same or similar to the combined height 168, 172 of the depression portion and cylindrical portion of the positioning features 146 of the lid 106. As such, the standoff 148 may have a height 178 ranging from approximately ¼" to approximately 6", from approximately ½" to approximately 4", or from approximately ¾" to approximately 2". Other standoff heights 178 outside the ranges provided may also be used.

As shown best in FIG. 1 and in cross-section in FIG. 6, the standoff 148 may include undercut corners 180 as the standoff 178 approaches the corners of the case 100. The undercut corners 180 may facilitate gripping by a human hand and allow the lid 106 to be pulled free from the interlocking engagement with the liner 104. In addition to providing for stacking and assisting in removal of the lid 106, the standoff 148 may also function to stiffen the lid 106 against bending and warping. As such, the lid 106 may be repeatedly opened and closed without damaging the lid 106. Note that, like FIG. 7, the standoff 148 may be omitted and the portion of lid 106 with position features 146 may be recessed to cause the tops of positioning features 146 to be flush with rim 144.

The lid 106 may be made from the same or similar materials as the liner 104 and may be the same or differing thickness. In some embodiments, for example, the lid 106 may be made thinner than the liner 104 or a thicker lid 106 may be used. In addition, the lid 106 may be made from a transparent or translucent material such that the products packaged in the case 100 may be seen through the lid 106. It is noted that the liner 104 may also be a transparent or translucent material. In some embodiments, the transparent or translucent portion of the lid 106 may be localized in particular portions of the lid 106 to reveal the packaged product. For example, the lid 106 may be generally opaque, but transparent or translucent portions may be provided on the top of the positioning features 146 of the lid 106 thereby revealing logos positioned, for example, on the bottle cap of the packaged product. In other embodiments, the lid 106 may be generally translucent and the top of the positioning features 146 on the lid 106 may be transparent. In still other embodiments, borders of opaque or translucent material may surround respective translucent/transparent or transparent material. Other arrangements and designs of translucency and transparency may also be provided.

While the secondary packaging system or case 100 has been described with respect to the embodiments shown, several alternatives and modifications may be made, which remain within the scope of the invention. For example, the carton or box 102 may have flaps extending from the top edge of the box wall 106, 108 and the liner 104 and corresponding lid 106 may be sized to fit fully within the box 102. In this embodiment, the flaps may be secured like a typical box adding to the secured nature of the secondary packaging and protecting against loss or dislodgement of the lid 106 during shipping and handling, for example if a case is tipped on its side or upside down. In this embodiment, additional internal spacer walls may be provided that are slightly shorter than the box walls allowing the flange 126, 150 of the liner 104 and lid 106 to rest on the top of the spacer walls within the walls 106, 108 of the box 102. These spacer walls may also be omitted.

In still another embodiment, the liner 104 may be used with a box 102 and the liner lid 106 may be omitted. In this embodiment, the flange 126 and skirt 128 may be omitted allowing flaps or other closure type elements to provide a top to the box and cover the top opening of the box 102 and the liner 104. In some embodiments, the top of the box may be formed integral with one or more side or end walls of the box 102 and the top of the box 102 may include perforations allowing the top of the box to be torn open exposing the product.

Figure 16:
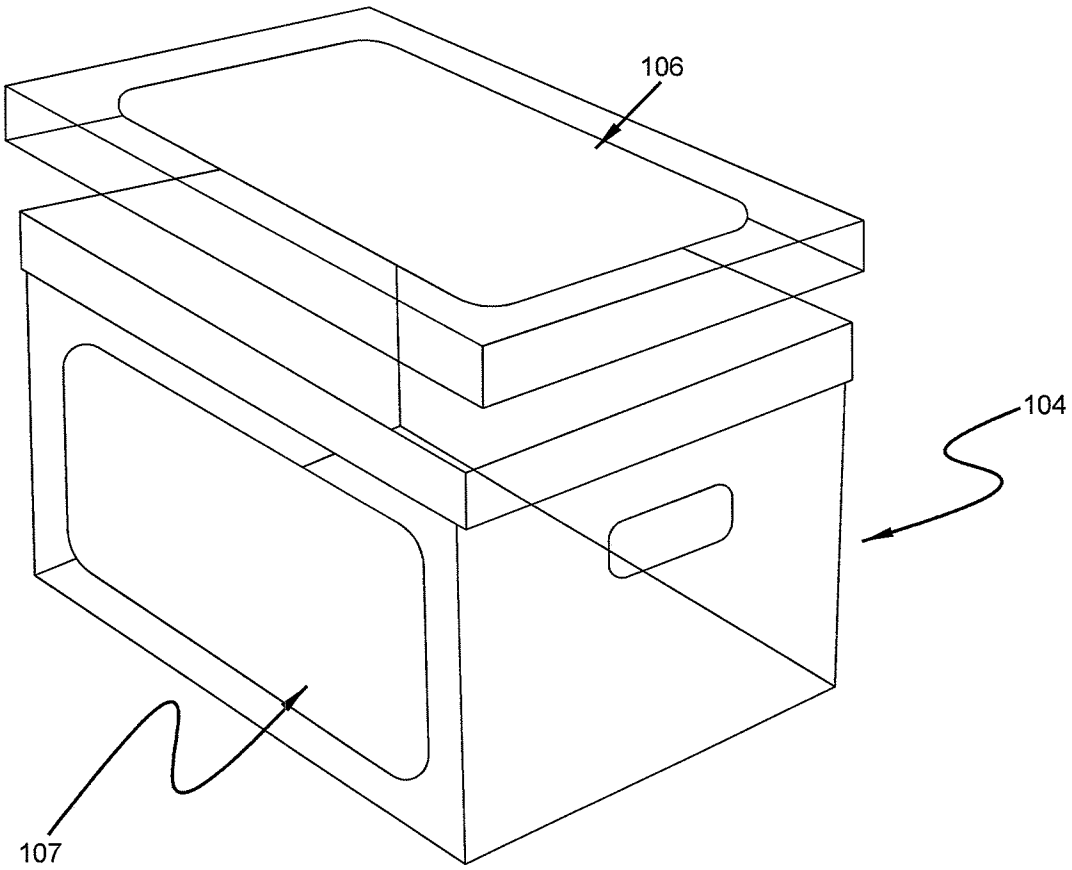
FIG. 16 is a perspective view of a liner container without an exterior box and a shoebox-type lid.

In still other embodiments, the carton or box 102 may be omitted. As shown in FIG. 16, for example, in this embodiment, the liner 104 may function as the lateral and vertical support for the packaged product and may also include logos or other labeling 107 required for commerce or desired for advertising and branding. Hand holds may be formed into the end walls 118 of the liner 104 or the flange 126 and skirt 128 may be used for lifting the case 100. As shown, a shoe box type lid may be provided or a lid similar to that shown in FIGS. 1-8 may be provided.

Figure 17:
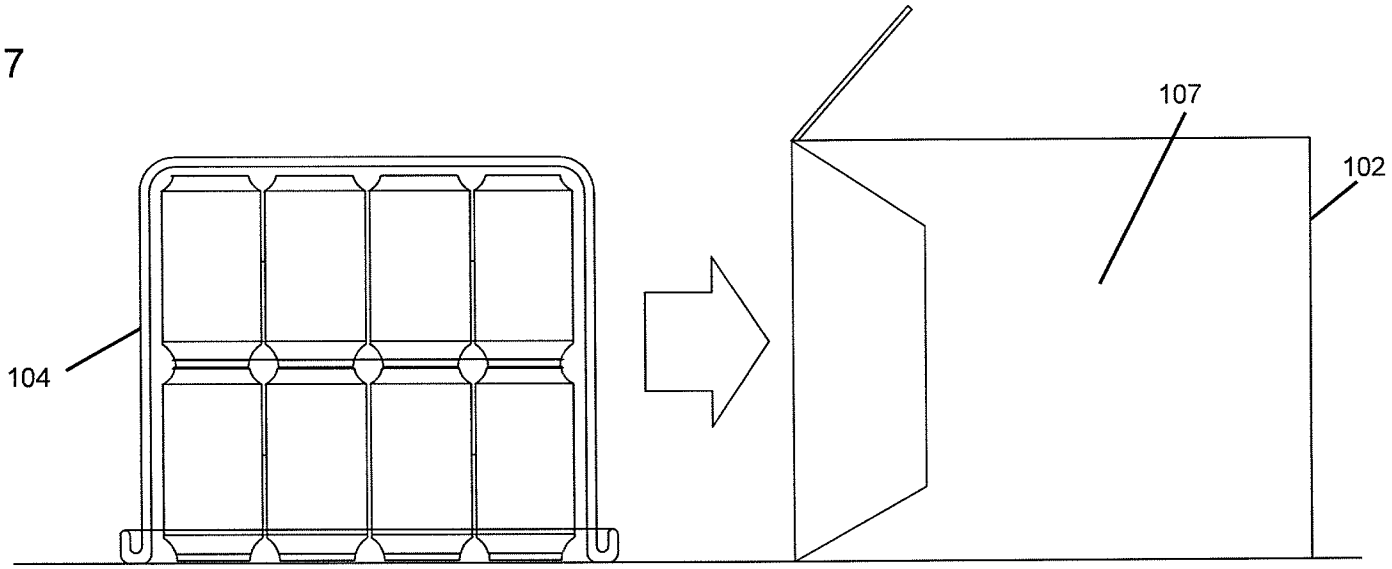
FIGS. 17 and 18 are side views of a liner and box depicting a side load process and an associated liner and box arrangement.
Figure 18:
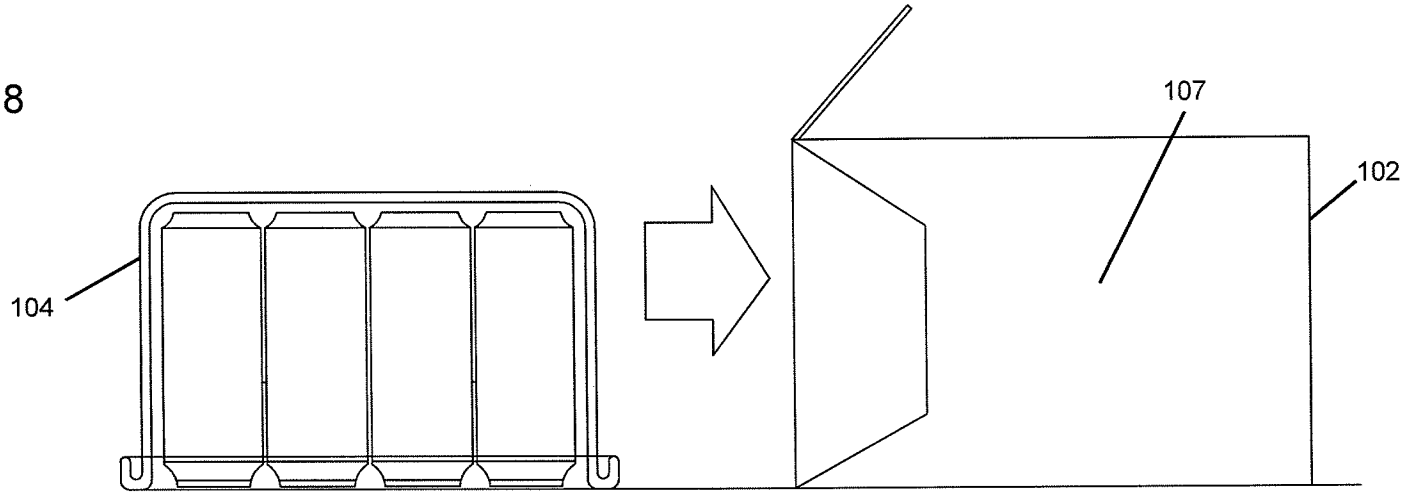

In still other embodiments, the carton or box 102 and liner 104 may be adapted for loading from a side, an end, or the bottom. As such, the open side of the box 102 and the lidded side of the liner 104 may be arranged or oriented to allow for loading from any side and the associated portions thereof may be arranged on vertically or horizontally extending edges as appropriate. In other embodiments, as shown in FIGS. 17 and 18, the liner and the box may be oriented with their open tops facing 90 degrees relative to one another. As shown, a 24 pack of 12 oz. cans, a 12 pack of 24 oz. cans, or other arrangement of cans, bottles, or other products, may be positioned and an inverted liner may be placed over the top of the products. The liner and products may then be slid laterally into a box using the stacking surface to maintain the product in the liner until the liner and product are positioned within the box. In this embodiment, a liner lid may be provided or omitted. Where provided, an inverted lid may be placed on surface, the inverted product may be placed thereon, and then the inverted liner may placed over the top of the product and secured to the lid. In still other embodiments, while being loaded from a side, end, or bottom, the configuration of the open top of the embodiment shown in FIGS. 1-8, for example, may remain and an alternative loading door or loading side may be provided. Sealing means for sealing the liner around the edges of the loading door or loading side may be provided similar to those described with respect to the hinged or otherwise secured lid described above.

In some embodiments, the liner 104 may be further adapted to accommodate the various loading directions described above. In some embodiments, the liner walls may be collapsible in a pleated, crushing, accordion, or other fashion. For example, the side walls may be generally flexible material that, for example, may collapse without the support of the surrounding box. In another example, the side walls may be more rigid and may include creases or fold lines allowing the side walls to collapse. In either of these cases, or others, the liner 104 may be initially provided in a substantially fully collapsed or flat arrangement. For example, this may be similar to holding the opening of a bag in an open position and collapsing the bag against a surface arranged below the bag. In this embodiment, upon receiving products from one or more of several directions, the perimeter of the liner may be sleevably extended from its collapsed position to an extended position around the product. For example, the collapsed liner 104 may be arranged similar to that shown in FIGS. 1-5, but with fully collapsed side walls. The product may be set in the liner 104 on the bottom of the liner 104 and then the walls may be grasped and pulled upward around the product. In other embodiments, the liner 104 may be arranged upside down and elevated above a location that product is to be placed. The product may be located below the liner 104 and the side walls may be pulled downward around the product and the filled liner 104 may then be uprighted or slid laterally into a box, for example. In still other embodiments, the liner 104 may be placed adjacent to a location for product to be placed. The product may be placed adjacent the liner 104 and the sidewalls of the liner 104 may be grasped and pulled sideways to encompass the product. Other arrangements and loading processes may also be used.

Figure 19A:
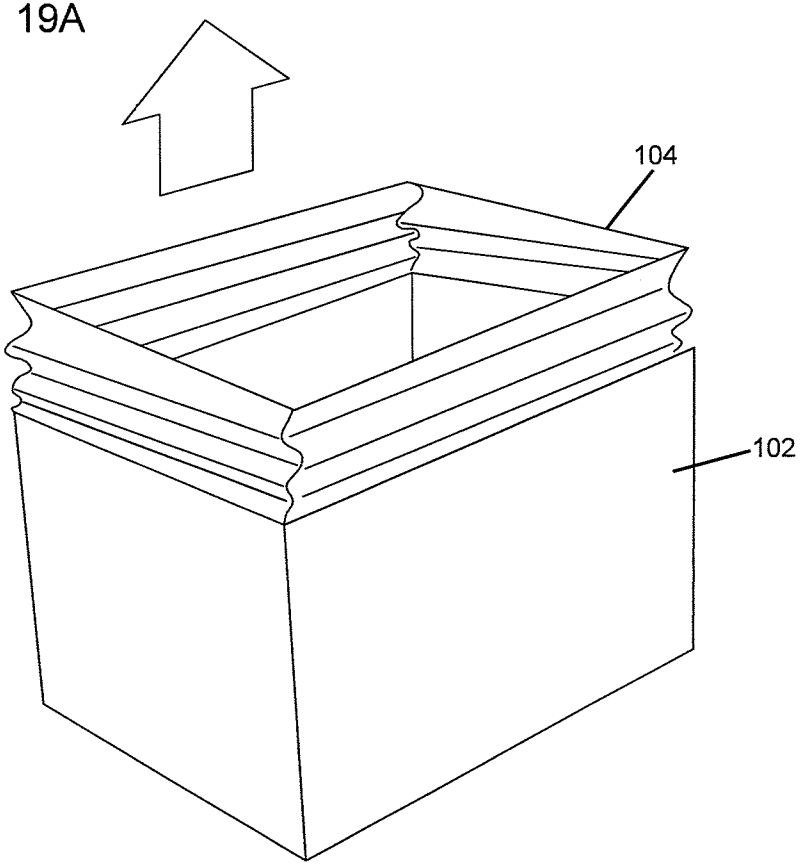
FIGS. 19 and 20 include perspective views of alternate arrangements of a liner adapted to be expanded above a product to contain ice.
Figure 19:
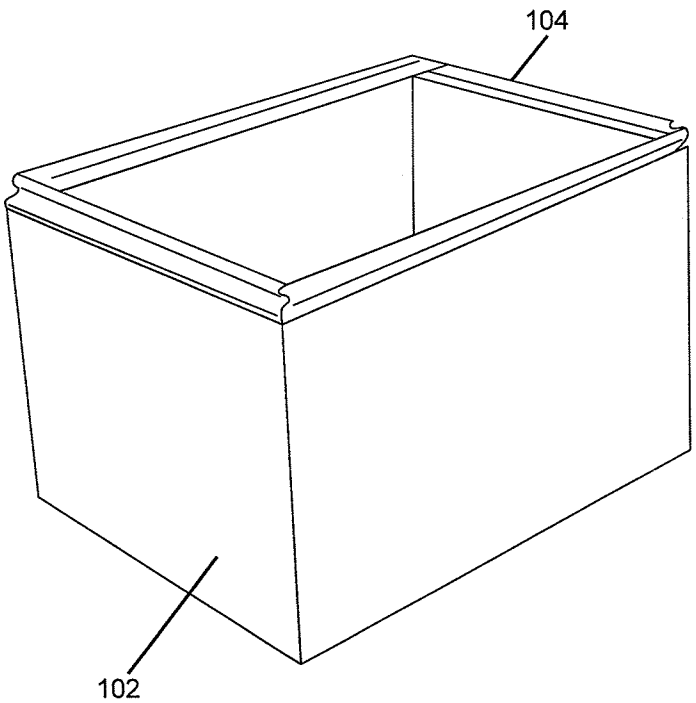
Figure 20A:
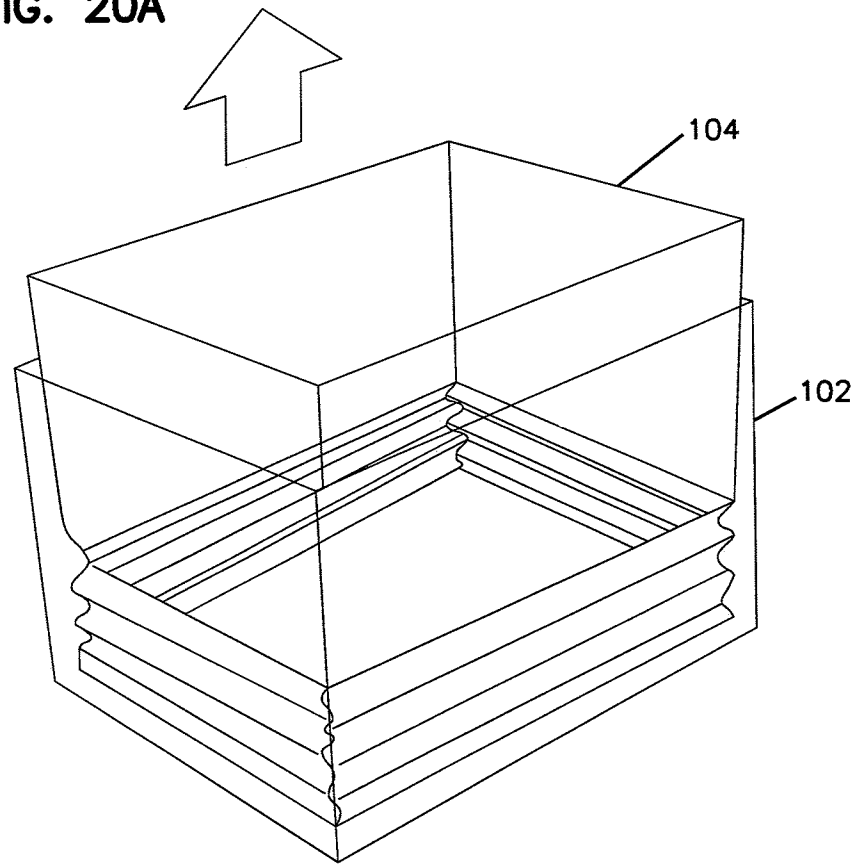
Figure 20:
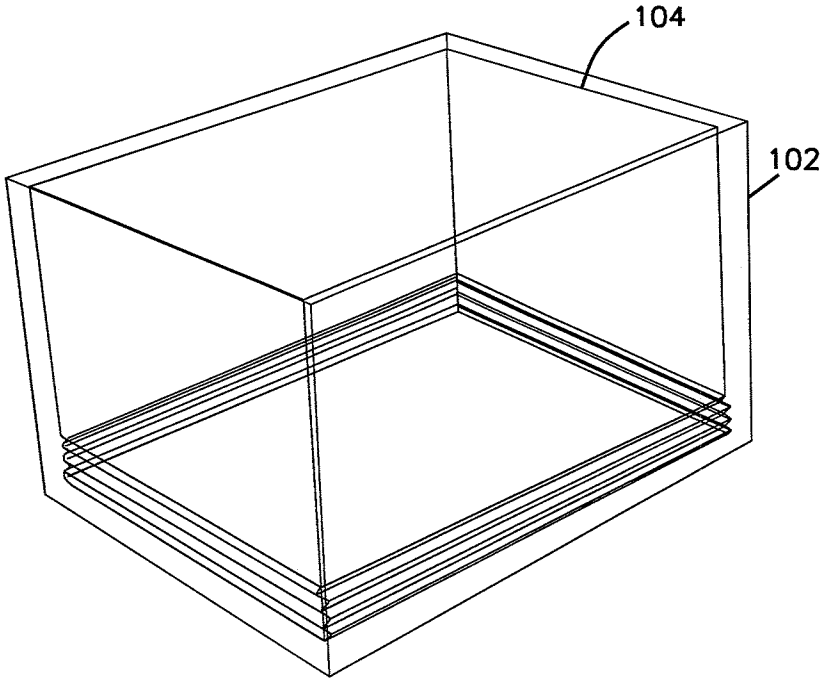
Figure 21A:
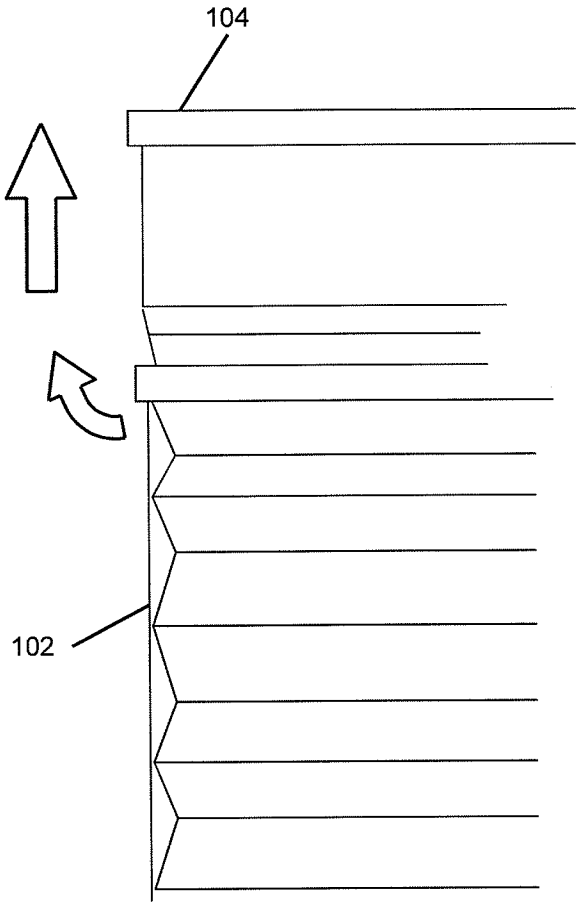
FIG. 21 includes another arrangement for expanding a liner above a product to contain ice and having a pop out tab for securing the liner in the expanded position.
Figure 21:
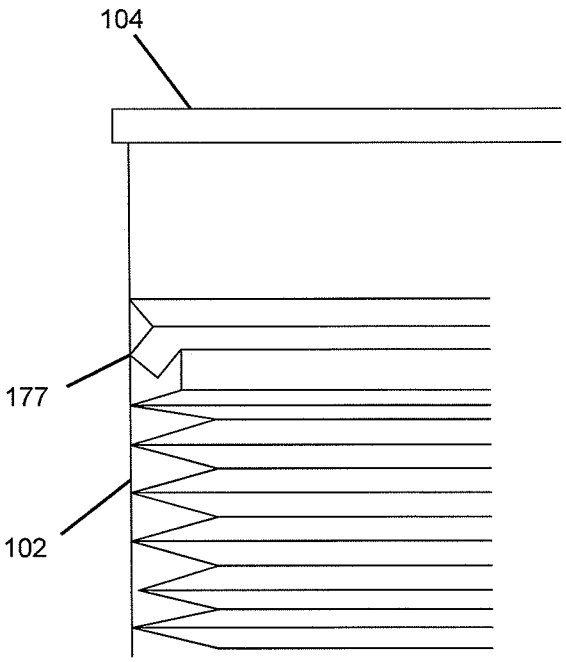

In still other embodiments, the liner sidewalls may have a height taller than the product being placed therein. For example, in the just described liner embodiments with collapsible sidewalls, when the sidewalls are extended around the product, the sidewalls may still not be fully extended. That is, the walls of the liner may be capable of extending further than the distance for encompassing the product. Accordingly, when an end user receives the packaged product in the liner 104 and box 102, the user may pull the sidewalls an additional distance upward to allow for containment of ice above the height of the product. In still other embodiments, as shown in FIGS. 19-21, the collapsibility of the liner sidewalls may be provided for particularly for this latter purpose (i.e., extending the liner to accommodate ice). In these embodiments, the collapsibility of the liner may thus be provided in a top portion of the liner sidewall as shown in FIG. 19. That is, the top ½, ⅓, or ¼ of the sidewall, for example, may have folds, creases, or accordion folds allowing the top portion of the liner 104 to be extended upward beyond the height of the product and provide for ice containment. In still other embodiments, as shown in FIG. 20, the bottom ⅓, ¼, or ½ may have the creases or folds allowing the liner sidewalls to travel upward and provide for ice containment above the height of the product.

In yet another embodiment, a catch 177 may be provided as shown in FIG. 21 for maintaining the ice accommodating portion of the liner above the height of the box once extended. For example, the liner side wall may include a pleated, accordion, or otherwise collapsible and extendable portion. Near the top of the liner side walls, a relatively rigid portion may be provided for being extended out of the box and upward for holding ice above the product. Near the bottom portion of this relatively rigid portion, a catch may be provided. For example, the catch may be a tab, plurality of tabs, or a peripherally extending nub, tab, or rib as shown. When the relatively rigid portion is pulled upward such that the catch is released from its containment within the box, the catch may pop outward causing it to resist re-entry into the box thereby holding the relatively rigid portion of the liner above the height of the box and allowing for containment of ice without drooping, sliding, or otherwise falling back down into or around the box.

In still other embodiments, the liner 104 may include top flaps similar to a box top. The liner flaps may be unfolded by an end user and arranged in an upright position. Adhering strips, foldable overlapping flaps, or other corner fastening devices may be provided to secure the vertical edges of the flaps to an adjacent flap providing for a circumferentially contained space above the product to contain ice placed in the liner 104 by the end user.

In still other embodiments, for example, the carton or box may include the top flaps. The box top flaps may be unfolded by an end user and arranged in an upright position. Adhering strips, foldable overlapping flaps, or other corner fastening devices may be provided to secure the vertical edges of the flaps to an adjacent flap providing for a circumferentially contained space above the product similar to that shown in U.S. Pat. No. 7,717,318, for example. In this embodiment, the liner may be extendable, for example, as described with respect to FIGS. 19-21, and the liner may extend upward along the inside of the unfolded and secured flaps. The liner may hook or otherwise be secured to the top edge or other portion of the unfolded flap to hold the liner upward.

In still other embodiments, the liner 104 described above may be adapted to accommodate nestably stacking a plurality of liners 104 within one another and may be further adapted to accommodate de-nesting of the liners 104. That is, the liner embodiment described with respect to FIGS. 1-5 may be stacked, one within another, to form a plurality of nested liners 104. The liners 104 may nest within, for example, a lower liner 104 for a majority of the depth of the liner 104 and the open bottom of the positioning features 132 and liner rim may allow the liners 104 to substantially fully nest, one within another. In some cases, the nesting of the liners 104 may create relatively high levels of friction and may create a seal between the liners 104 when nested similar to a stack of buckets, for example, such that when attempting to remove a liner from a stack, a suction effect may make it difficult to remove the liner. Accordingly, to accommodate de-nesting of the liners 104, the liners 104 may include one or more de-nesting features adapted to reduce the amount of force used to separate or de-nesting the liners 104.

In one embodiment, the de-nesting feature may be provided by omitting one or more of the positioning features 132 in the bottom of the liner 104. That is, in contrast with FIG. 5, for example, were a positioning feature 132 omitted, the bottom of the liner 104 may be substantially flat and uninterrupted at the location of the omitted feature 132. The selected positioning features 132 that are omitted may have a pattern about the center of the bottom of the liner 104 that allows for changing the pattern by rotating the liner 104. That is, for example, one or more positioning features 132 may be omitted from one side of the liner bottom and not the other side. As such, when the liner is rotated 180 degrees, for example, the arrangement of the positioning features 132 would change from the non-rotated position to the rotated position. This is in contrast to, for example, where corresponding positioning features 132 on each side of the bottom were omitted. In this latter case, rotating the liner 180 degrees may provide the same pattern as the non-rotated liner. With positioning features 132 being omitted that allow for changing the pattern by rotating the liner, the liners 104 may be stacked or nested and each liner 104 may be rotated or turned relative to the receiving liner 104 such that the omitted positioning feature 132 of the inserted liner 104 rests on top of a positioning feature 132 in the receiving liner 104 and prevents full nesting of the liner 104. It is noted that where the liner 104 is rectangular as in FIGS. 1-5, rotation of the liner 180 degrees may be used. However, where other shaped liners 104 are provided, other rotation angles may also be used. For example, where a square liner 104 is provided, a rotation of 90 degrees or 180 degrees may be used.

Figure 22:
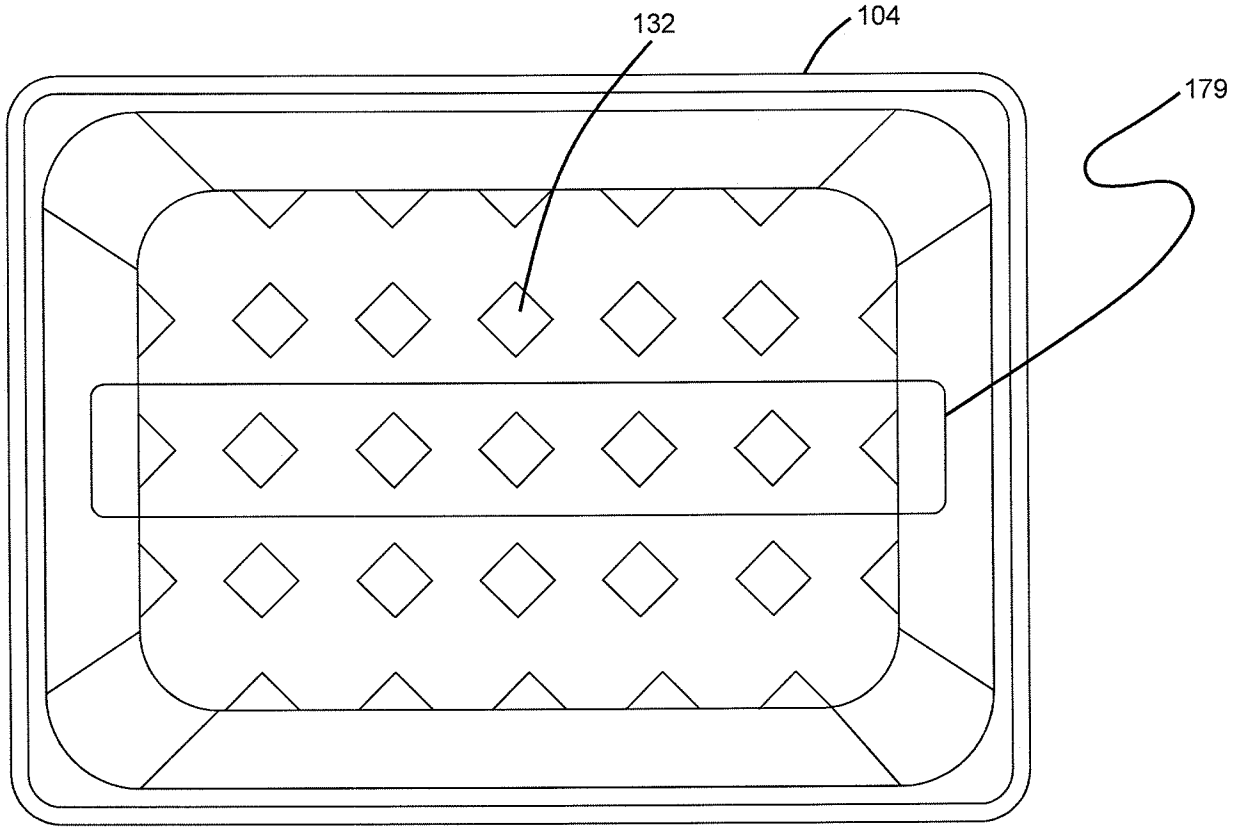
FIG. 22 is a bottom view of a liner showing a covering placed over recess formed by positioning features.

In a similar embodiment, as shown in FIG. 22, rather than omitting positioning features 132, a label or other covering element 179 may be provided on the outside of the bottom of the liner 104 to cover the recess provided by one or more of the positioning features 132. As such, when the liner 104 is inserted into a receiving liner 104, the label on the received liner 104 may rest on top of a positioning feature 132 of the receiving liner 104. Here, the liners 104 may be stacked without rotating the liners with respect to one another.

In another similar embodiment, rather than omitting the positioning features 132, the shapes of the positioning features 132 may be selected and arranged such that the positioning features on the received liner 104 do not match those of the receiving liner 104. For example, a generally diamond-shaped pyramidal positioning feature 132 such as the ones shown in FIGS. 1-5 may be provided. However, some of the positioning features 132 may be provided with differing geometries that do not readily nest with the generally diamond-shaped pyramidal geometry. For example, a generally square positioning feature 132 may not receive a generally diamond-shaped positioning feature 132. The positioning features 132 with the differing geometry may be arranged in a pattern similar to the omitted positioning features 132 described above. Additionally, alternating rotation of the liners 104 in a stack may cause the differing positioning features 132 to prevent overly tight nesting.

Figure 23:
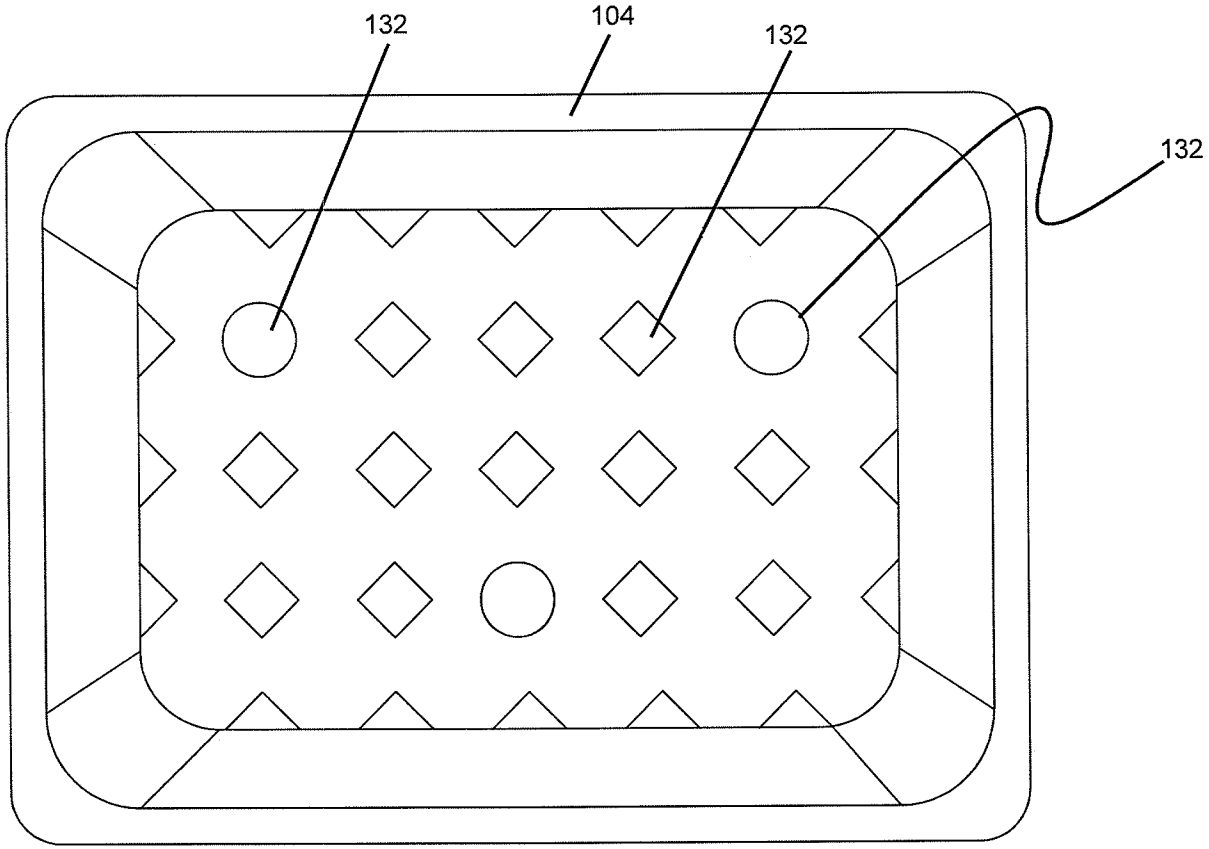
FIG. 23 is a top view of a liner having alternately shaped positioning features in some locations.

As shown in FIG. 23, for example, the near corner positioning features (i.e., the $1^{st}$ and $5^{th}$ positioning features in row 1) on one side of the liner may have an alternate shape and the center positioning feature (i.e., the $3^{rd}$ positioning feature in row 3) on the opposite side of the liner may have an alternate shape. The alternate shape may be shaped and sized to avoid readily nesting with both a received and receiving liner. Alternating rotation of the liners 104 in a stack may cause the differing positioning features 132 to prevent overly tight nesting.

In still another embodiment, the equipment forming the liners 104 may allow for varying the pattern or orientation of one, some, or all of the positioning features 132 in the bottom of the liner 104 such that liners 104 may have varying arrangements of positioning features 132 and stacking the liners 104 may naturally allow for some separation to be maintained. This may be by way of an orientation change of a portion of a die or press forming the positioning feature 132. In other embodiments, adjacent assembly lines, for example, may be provided to create differing liners 104 and the liners 104 from one line may be alternately stacked with liners 104 from the adjacent line allowing the differing geometries to maintain some separation of the stacked liners 104 and prevent full nesting from occurring.

Figure 24:
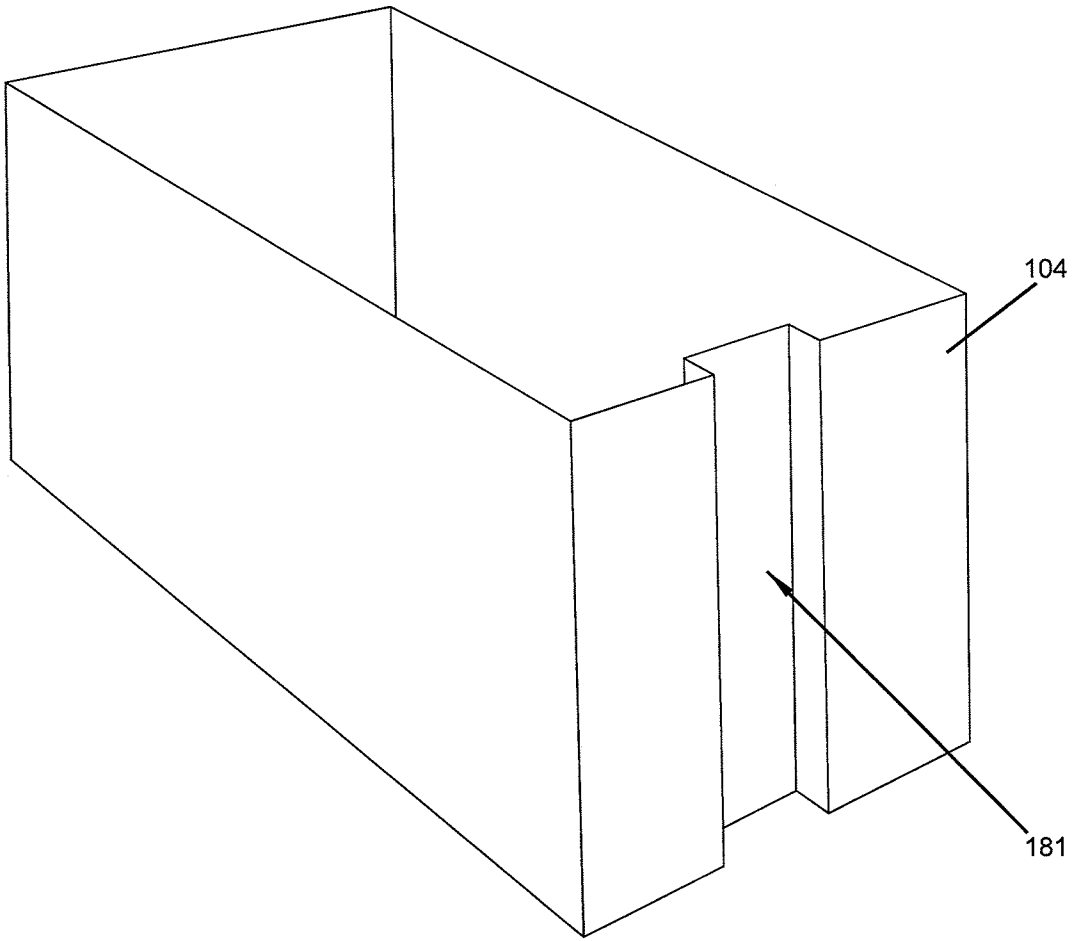
FIG. 24 is a perspective view of a container having a side slot or cavity for allowing air to flow around the container when stacked.

In still other embodiments, as shown in FIG. 24, an air channel 181 may be provided allowing air to flow in behind a nested liner as the liner is removed from the stack. In this embodiment, liners may be rotated as they are stacked such that each air channel may be positioned adjacent a substantially flat sidewall of the receiving liner. The air channel may allow air to flow between the channel and the receiving liner sidewall as the nested liner is removed.

Figure 25:
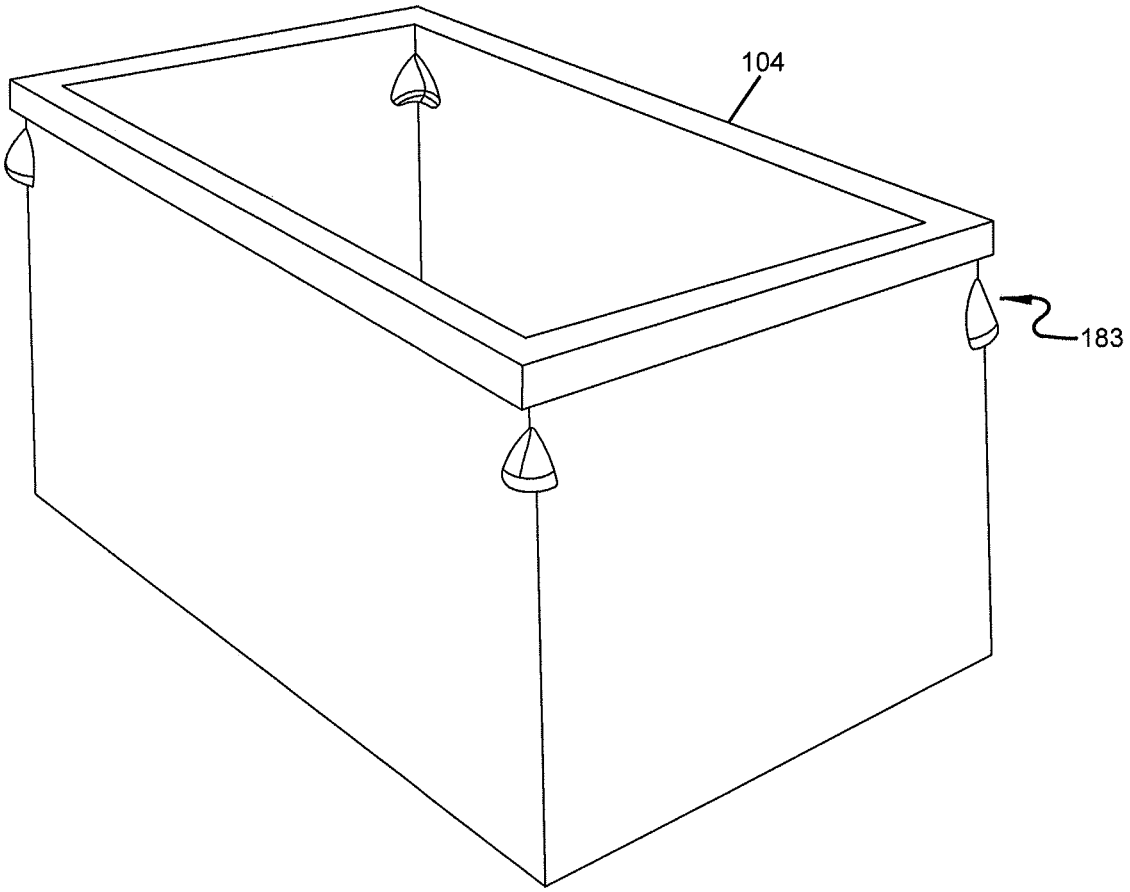
FIG. 25 is a perspective view of a liner having corner lug de-nesting features.
Figure 25A:
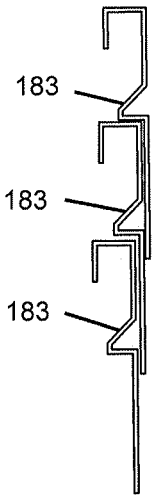

In another embodiment, a de-nesting feature may include one or more outwardly protruding lugs 183. For example, as shown in FIG. 25, an outwardly protruding lug may be provided on each of the four corners of the liner 104. The lugs may be positioned below the flange 126 and may be adapted to support the liner 104 by resting on the flange 126 of a receiving liner 104. That is, as the liner 104 is inserted into a receiving liner 104, due to the position of the protruding lug below the flange 126, the protruding lug may come into contact with the flange 126 of the receiving liner 104 prior to the inserted liner 104 becoming fully nested in the receiving liner 104. The protruding lug may thus allow for maintaining the separation between nested liners 104. The protruding lug may be a formed portion of the liner 104 or may be adhered to the outside of the liner 104. In some embodiments multiple protruding lugs may be provided around the periphery of the liner. In still other embodiments, the protruding lug may be a continuous rib extending around the perimeter of the liner 104 near the top of the liner 104 and below the flange 126.

Figure 26:
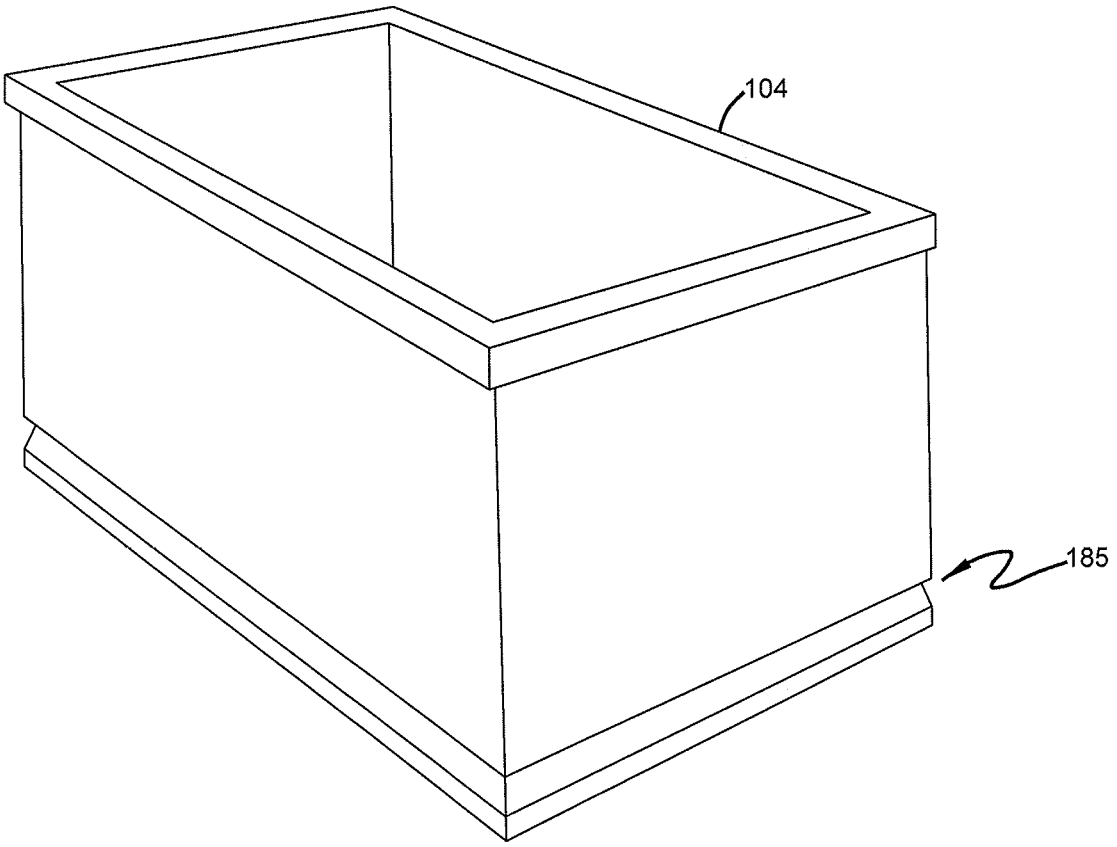
FIG. 26 is a perspective view of a liner having a bottom rib de-nesting feature.
Figure 26A:
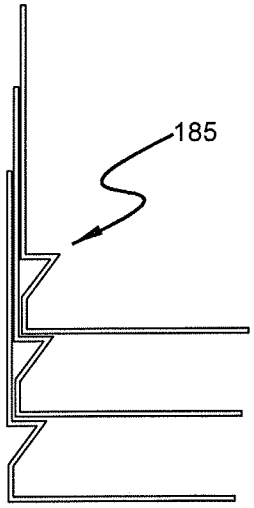

In still another embodiment, a similar de-nesting feature may include an inwardly protruding lug, rib, or ledge 185, as shown in FIG. 26, for example. In this embodiment, the ledge may be positioned near the bottom of the liner 104 and extend inwardly into the interior space of the liner 104. The lug may be adapted to support a received liner 104 by providing a surface upon which the bottom of a received liner 104 may rest. In some embodiments, multiple lugs may be provided around the periphery of the liner 104 and in one embodiment, as shown, a substantially continuous rib or bead may extend along the inner periphery of the liner 104.

Figure 27A:
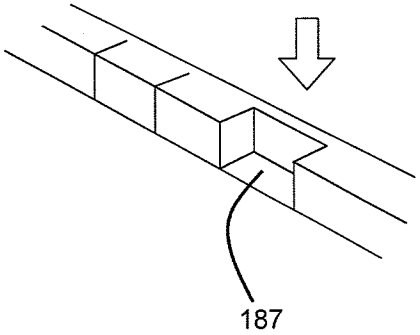
FIG. 27 is a perspective view of a liner having de-nesting features arranged on the rim of the liner.
Figure 27B:
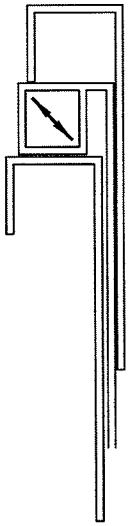
Figure 27:
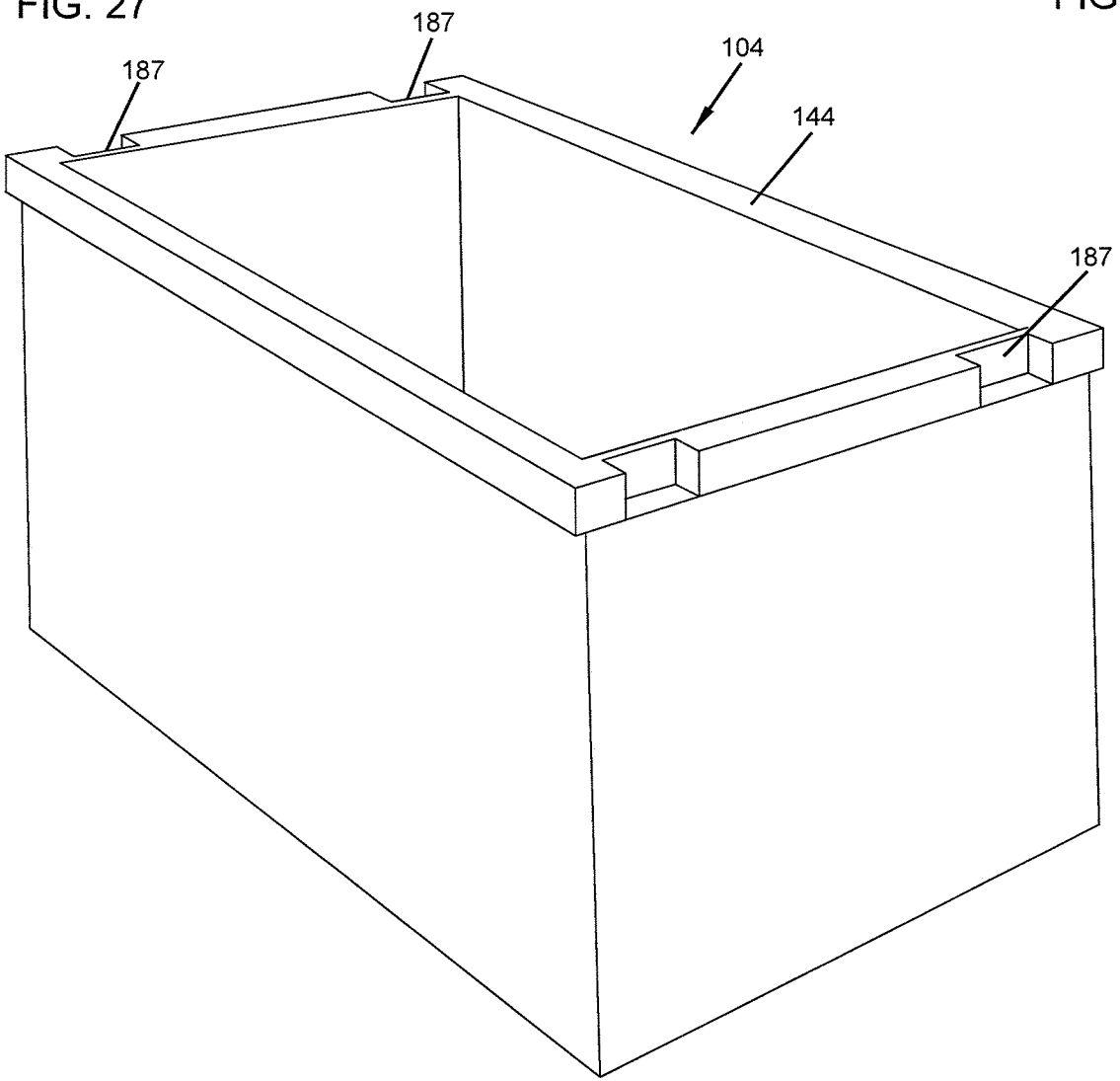

In yet another embodiment, a de-nesting feature may be included as part of the rim of the liner. As shown in FIG. 27, slots in the rim of the liner may be provided to define depressible selection buttons 187. The buttons 187 may be pressed and may snap through to an inverted position. When stacked, the inverted buttons 187 of the received liner may rest on the rim of the receiving liner where the receiving liner may have non-inverted buttons at the corresponding location. Once in place, an additional liner with inverted buttons at a differing location may be stacked. As shown in the stacked view, the liners may have varying inverted button locations to allow the inverted buttons 187 to rest on the surface of the rim of the receiving liner.

Figure 28A:
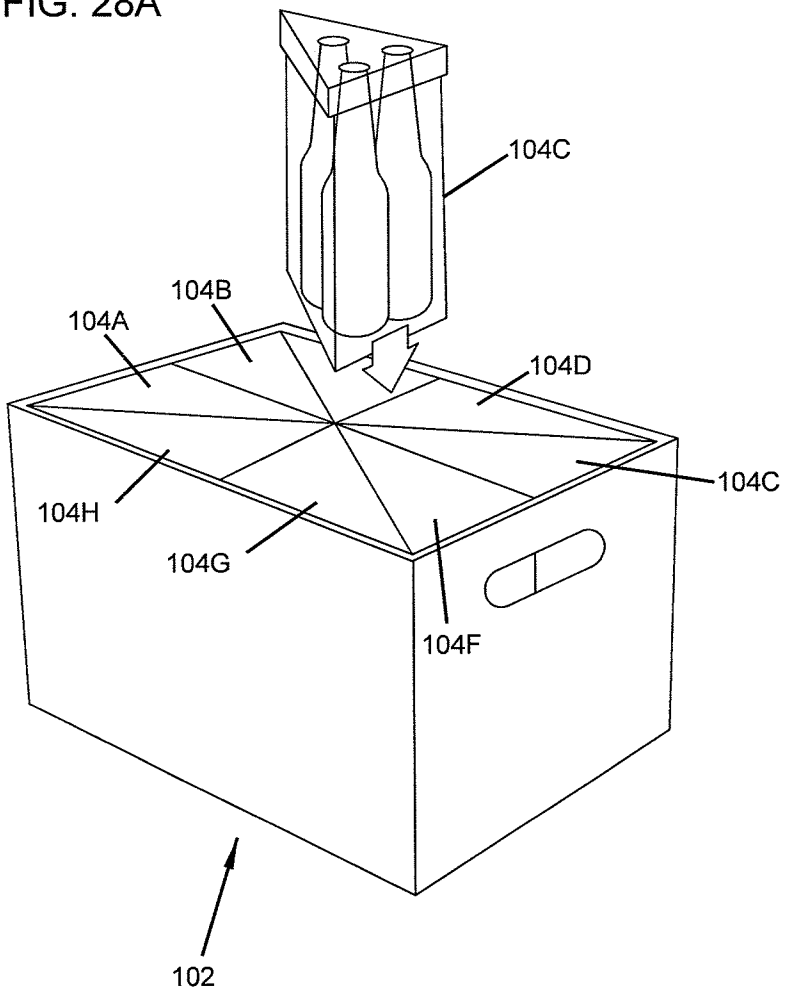
FIG. 28 includes perspective views of containers having multiple liners positioned therein.
Figure 28:
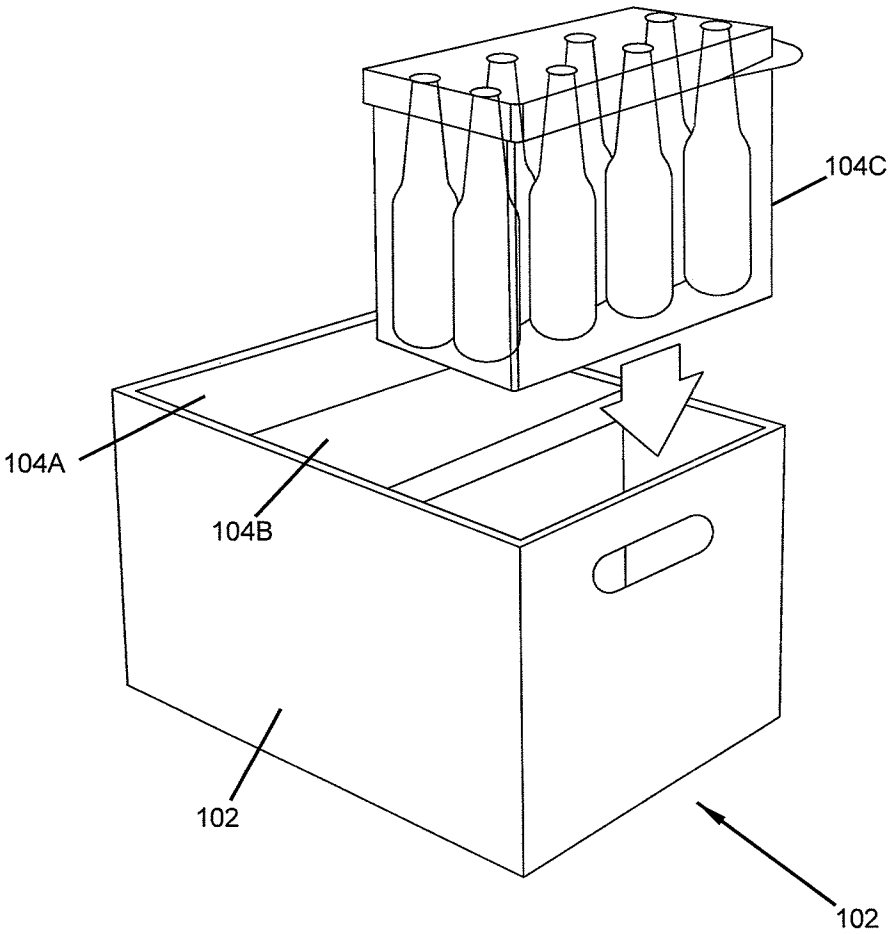

In still other embodiments, as shown in FIG. 28, the multiple liners may be provided within the carton or box. As shown, for example, three liners and lids may be provided that each hold eight bottles each. In another example, eight liners and lids are shown that each hold three bottles each. Other arrangements may be provided such as four liners with six bottles, six liners with four bottles, two liners with twelve bottles, twelve liners with two bottles and other combinations not equally divisible into twenty four. The liners may be square, rectangular, triangular, or other shapes. Each of the multiple liners may be used to remove a particular number of products from the larger case and also may allow for placement of ice within the liners to cool the product. As such, a portion of the packaged products may be used at a given time in addition to allowing for all of them to be used.

Figure 29B:
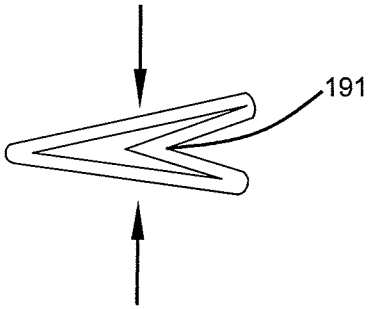
FIG. 29 includes perspective views of liners for use with the container of FIG. 28 or other similar container.
Figure 29A:
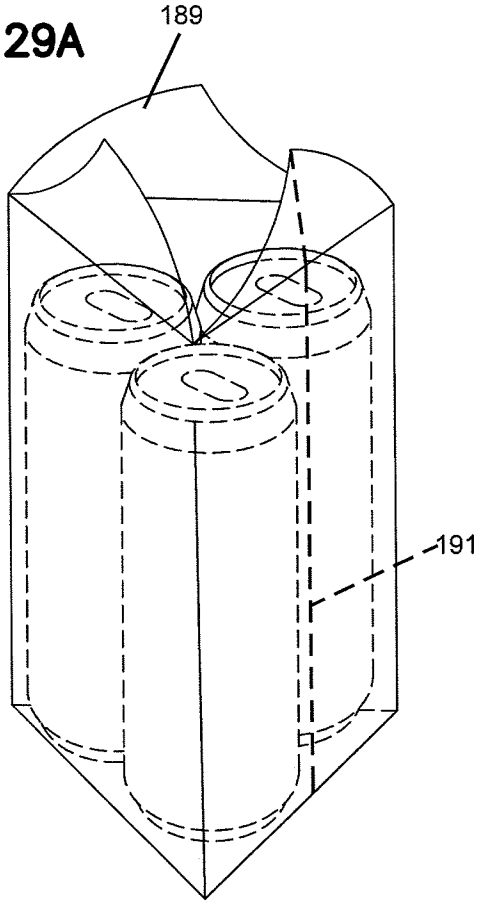
Figure 29:
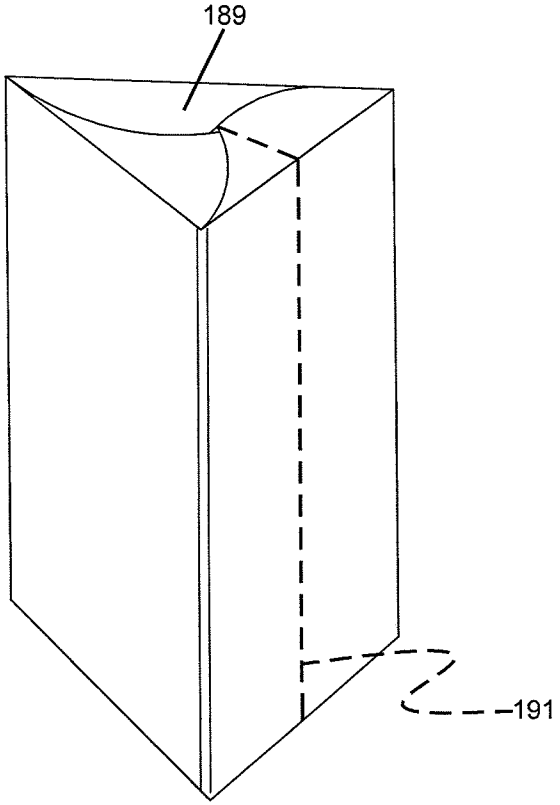

In another embodiment, as shown in FIG. 29, the liners used within the case may include flaps 189 for closure of the liner. For example, as shown, the triangular liner may include interweaving flaps 189 having slots formed therein for receiving and securing the flaps in a closed position. The bottom may have be similarly formed. In addition, the liner may include a crease, score line, or other linear weakening element 191 extending along a side thereof allowing for collapsing of the liner.

Figure 30:
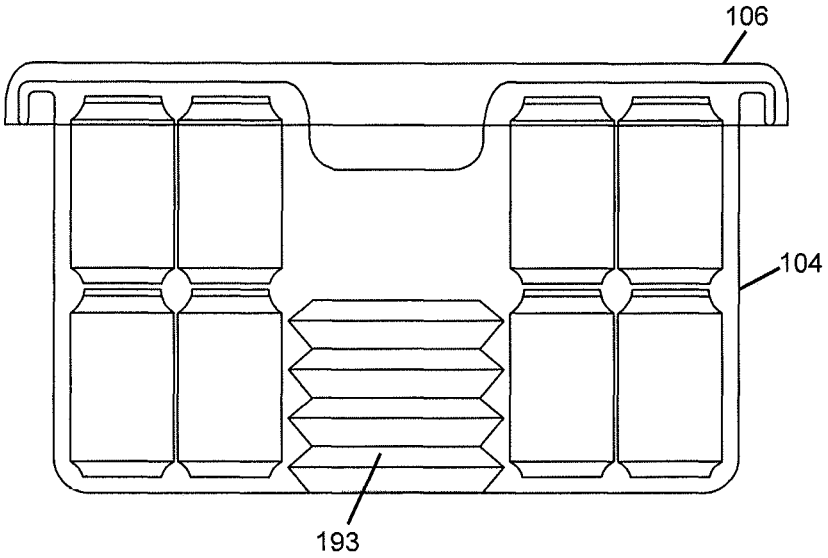
FIG. 30 includes two side views of a container having a dividing bellows that is collapsible to accommodate placement of ice.
Figure 30A:
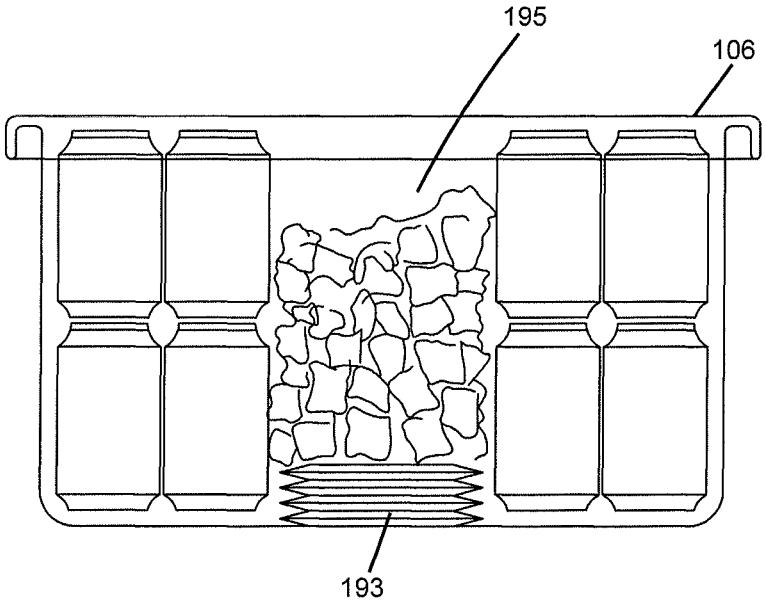

In still other embodiments, the system described above may include a collapsible separation system 193 as shown in FIG. 30, for example. The collapsible separation system 193 may be configured to separate and hold products in position. The separation system may include a container portion and a lid portion in registration with one another to keep individual or groups of products in position in the container. As shown in FIG. 30, the container portion may be collapsible under the weight of ice 195, for example, such that adding ice to the liner will cause the liner to make room to receive the ice. While a single central system is shown here, the positioning features 132 described above may be adapted such that some or all of the positioning features have this collapsibility. The collapsibility may be provided by an air releasing bellows system, a generally deformable or compressible material, or other system. In some embodiments, the collapsibility may be provided in one direction and not another direction such that lateral positions of products may be maintained, but the element may collapse as shown to allow for space for ice or for other reasons.

Figure 31:
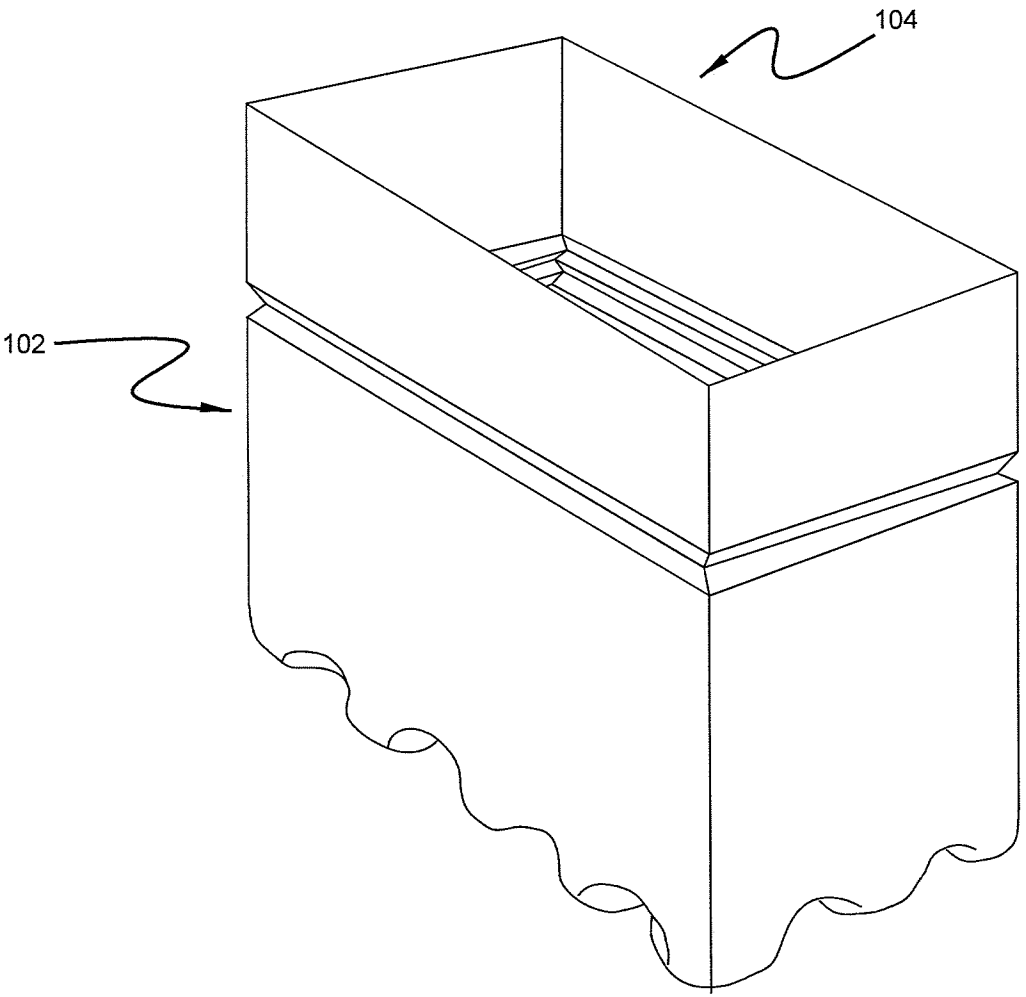
FIG. 31 is a perspective view of a liner having a rigid shell and a soft liner arranged therein.

In still other embodiments, the system may include a rigid shell with a soft liner. As shown in FIG. 31, for example, a lower portion may be provided including a relatively rigid material and a relatively flexible liner may be placed therein that may extend above the lower portion. The liner may be deployed as a one-use cooler liner for plastic totes and crates commonly found in refillable bottle applications globally. (e.g., milk crates and the like) The rigid crate with an open grid bottom, for example, may otherwise functional alone for carrying and for bulk transport. With the liner inserted therein, the crate may be transformed into an ice and water tight holding product to cool beverage bottles therein for retailers and consumers. This may be particularly useful for rapidly cooling beverages with ice and for retail point of display and sale.

Figure 32A:
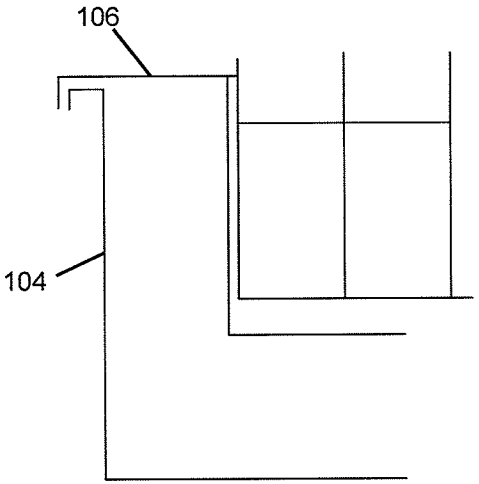
FIG. 32 is a container having an outer shell and lid with recesses for suspending products within the container.
Figure 32:
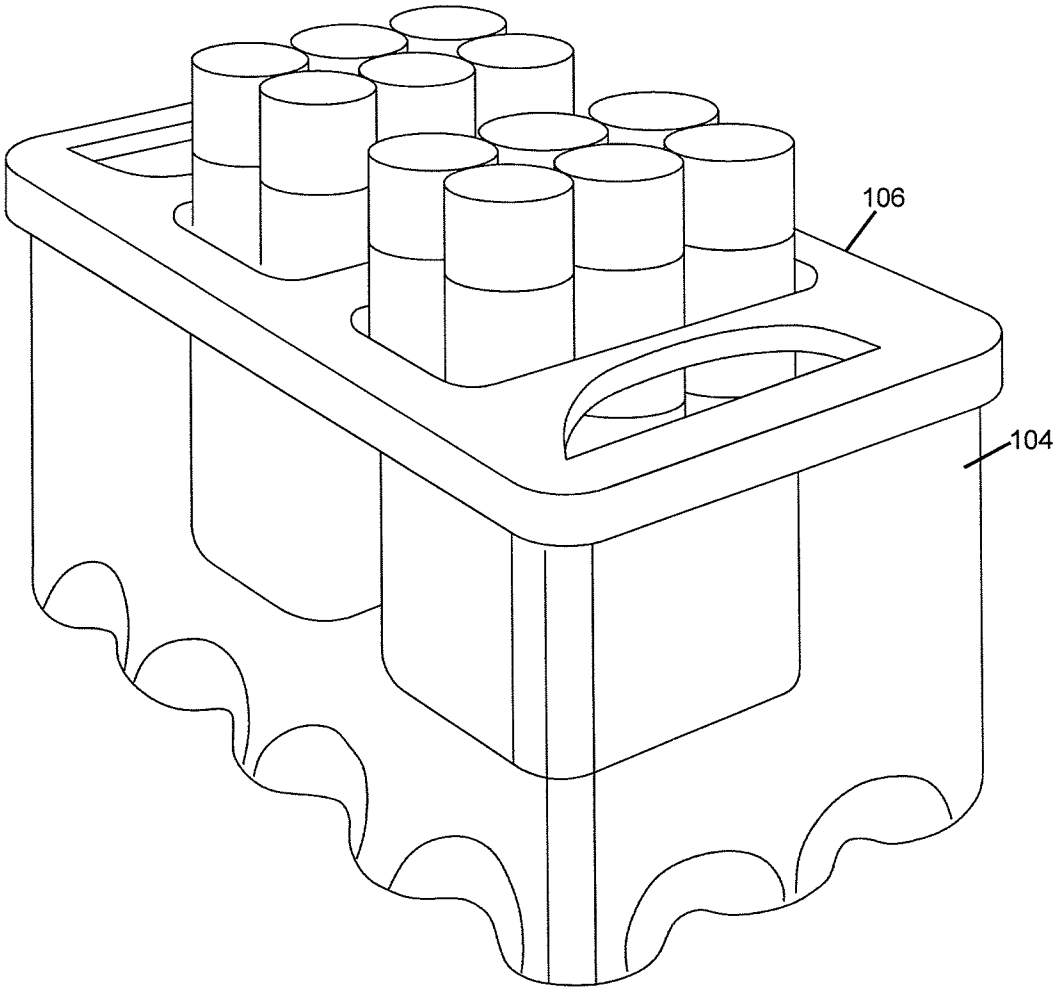

In still other embodiments, the system may include a relatively rigid shell with a relatively rigid lid as shown in FIG. 32, for example. The lid may include one or more recesses for arrangement of products therein. The recesses, for example, may include depressions sized to receive a six pack or other arrangement of beverages. The recesses may extend into the container from the lid surface and allow for ice, water, or other temperature affecting material to be placed within the container to surround the product and adjust its temperature. The lid may also include one or more openings for adding the temperature affecting and/or controlling material or medium to the container.

Figure 33A:
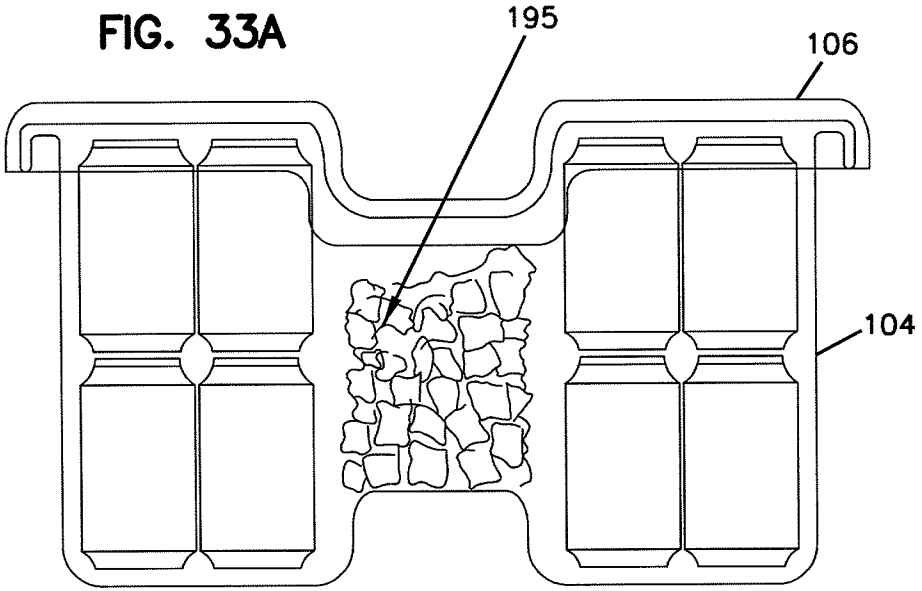
FIG. 33 is two side views of a container having a void space between products.
Figure 33:
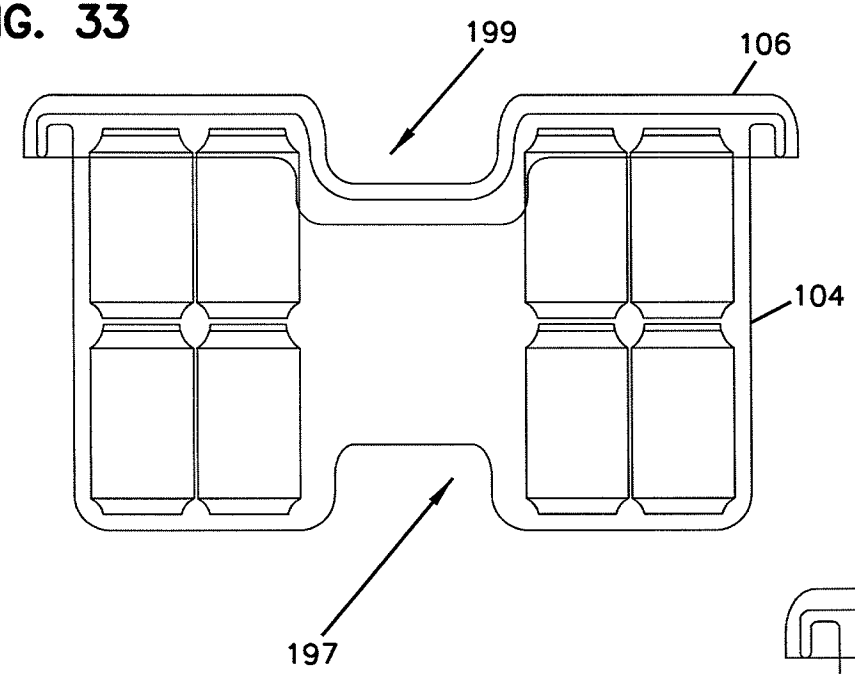

In still other embodiments, as shown in FIG. 33, the liner and lid may each have a contoured portion, 197, 199. The contoured portions 197, 199 may be in registration with one another as shown and may define one or more product holding compartments. The compartments may be sized and shaped, for example, to hold a particular number of bottles, cans, stacked cans, or other products. The compartments may include bordering sidewalls substantially surrounding the products to maintain the products in position within the compartment. The contoured portions may also define a void space between the compartments. As shown, the void space may be used for adding ice 195 or other temperature effecting materials between the compartments. Other items may also be placed in the void space.

Figure 34A:
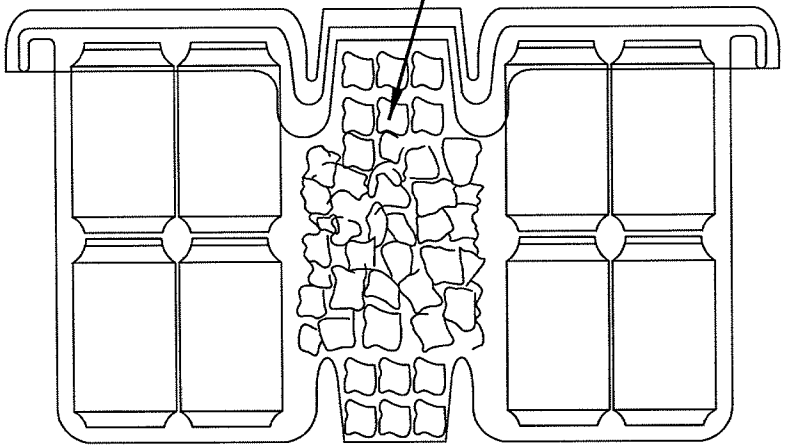
FIG. 34 is two side views of another container having a void space between products.
Figure 34:
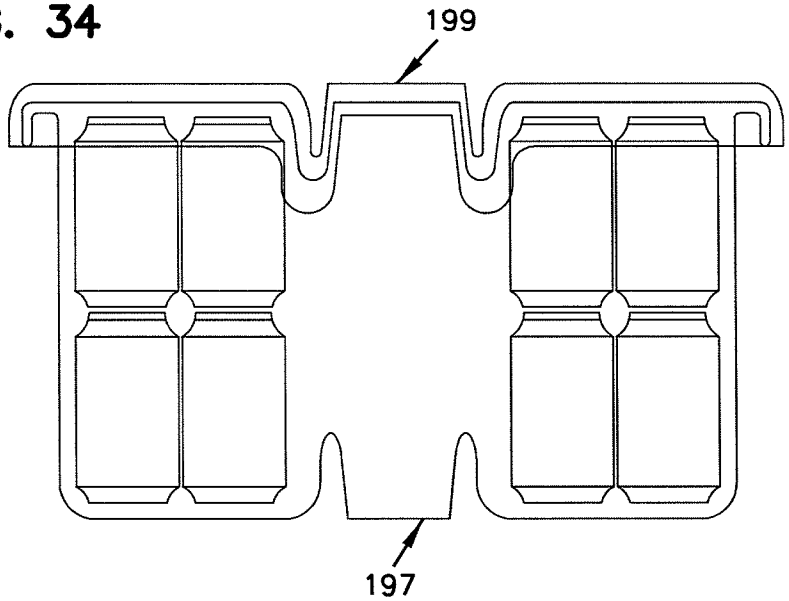

In still other embodiments, for example, as shown in FIG. 34, the void space may be made larger than that of FIG. 33 by returning the contoured portions 197, 199 of the liner bottom and the lid to a position flush with the respective compartment portion of the liner bottom and compartment portion of the lid. In some embodiments, the liner bottom may return to a position flush with the compartment portion of the liner bottom or the lid may return to a position flush with the compartment portion of the lid, or both the liner bottom and lid may return as shown.

While the present disclosure has generally been described with respect to bottled products such as bottled beverages or beer, other products may also be accommodated by the secondary packaging system described. For example, other bottled products including other beverages such as wine, soda, or water may be accommodated. Other bottled products including dressings, condiments, personal care products, or other bottled products may also be accommodated. In addition, other non-bottled products, for example, canned products, bagged products, shrink wrapped products, or jug-type products may be provided for with the system described herein. Still other products may be used and accommodated.

It is also noted that several embodiments, portions, features, and elements of a secondary packaging system have been disclosed and described herein. These embodiments, portions, features, and elements may not be mutually exclusive and combinations of the disclosed embodiments, portions, features, and elements are within the scope of the invention. For example, in some embodiments, the products arranged in the system may pack relatively tightly or less tightly depending on the geometry of the product as well as any separation, void space, or other features of the system. Depending on the goal of the product, more or less separation may be provided between individual products or clusters of products. For example, cans may tend to pack relatively tightly and provisions for void space to accommodate a cooling medium, such as ice may be desirable for packaging cans. As such, in one exemplary combination of the disclosed embodiments, the void space concept of FIGS. 33 and 34 may be introduced into the side loading concept of FIGS. 17 and 18, for example. Another exemplary combination of the disclosed embodiments may include combining one ore more of the hinged lid concepts of FIGS. 8-12 with the extendable liner concepts of FIGS. 19-21. In yet another exemplary combination of embodiments, any one or more of the de-nesting concepts of FIGS. 22-27 may be combined with most any other embodiment. In still another exemplary combination of embodiments, the system lid system of FIG. 32 may be used with most any of the box and liner embodiments disclosed. Other combinations of embodiments, features, portions, or elements may also be made and are all within the scope of the invention.

The secondary packaging system may be advantageous for several reasons relating to reduction of bottle breakage and related losses and other damage. For example, the overhanging standoff bumper, provided by the flange 126 and skirt 128 of the liner 104 and flange 150 and lip 152 of the lid 106, may provide a perimeter cushion-bumper to reduce and buffer case shock and impact throughout the manufacture and distribution channel of the system, particularly in the case of glass bottles. The bumper may lower the impact and reduce the potential for product breakage and container surface scuff and abrasion. For example, the bumper may absorb and resist damaging shock and impact of the peripheral products in a case 100 in conveyor transfers, palletization operations, manual and automatic stack and unstack operations, route handling, wholesaler/retail distribution and the like.

The over hanging bumper may be further advantageous by strengthening the hand holds 114 of the box 102. That is, as a user grips the hand holds 114, the portion of the box 102 above the hand holds 114 may be pressed upward against the bottom surface of the overhanging bumper of the liner 104. The load transfer from the hand holds 114 to the liner 104 may then be partially transferred to the liner 104 through compression in this portion of the box 102 above the hand holds 114 as opposed to limiting the load transfer to a shear transfer at either end of this portion of the box 102 above the hand holds 114. As such, the hand holds 114 may be stronger and less apt to fail via tearing. Still further, it is noted that with fingers placed in the hand holds 114 and a thumb placed on the lid 106, an exceptional grip may be provided.

The positioning features 132, 146 in the lid 106 and the liner 104 may restrict free motion of the containers within the case. The features 132, 146 may serve to inhibit container lean and hinge motion that can produce horizontal stress and impact between individual containers, especially tall bottle containers.

The liner 104 may provide an interior wall within a standard corrugated case shell to further absorb vibration and shock from external impacts that could cause product breakage. The liner 104 may be custom dimensioned and of a geometry to hold containers as tight or loose as desired for packaging operations. As such, the liner 104 may compensate and improve package performance where partitions and other internal separations may have been reduced and/or removed.

In some circumstances, a product within the case 100 may be damaged. In these circumstances, the liner 104 may offer additional advantages. For example, the liner 104 may retain liquid/materials that otherwise could leak from the case 100. This may limit soiling and further damage to surrounding materials generally beneath or near the case 100. The transparent or translucent lid 106 may also be advantageous in these circumstances by allowing for visible inspection of the case 100 and allowing cases 100 with damaged products to be isolated without opening the cases 100. Still further, the liner 104 may offer containment of broken products and thus reduce injury from, for example, broken glass. It is noted that the hand holds 114 of the carton or box 102 may not extend through the liner 104 and as such, the case 100 may be carried without having the hands of the carrier exposed to the product. As such, even where a broken product is present, the case 100 may be carried without exposure to dangerous chards of glass, for example.

Still further advantages may include providing additional wall stiffness to the case 100. The flange 126 and skirt 128 of the liner 104 and flange 150 and lip 152 of the lid 106 may engage and strengthen the perimeter of the case 100. This may help to resist case bowing from stacking compression or humidity fluctuations during storage. This may allow for corrugated construction downgrade relative to commonly used grades, longer storage conditions relative to current standards, and/or taller stack heights compared to current heights. Still further, this may allow for incorporation of POS cut-aways, perforations and other promotional revisions known to reduce corrugated structural integrity.

The positioning features 146 and standoff elements 148 of the lid 106 may be advantageous in reducing or minimizing the thickness of material needed to form the lid 106. The features may stiffen the lid 106 and, while quite thin, may allow the lid 106 to avoid warping and lay flat from one corner to another.

The interlocking engagement of the lip 152 of the lid 106 and the skirt 128 of the liner 104 may provide for a snap on lid, which may reduce the materials commonly required for closure of secondary packaging systems. This engagement may also provide for re-closeability, which may allow, among other things, the case 100 to be used as a recycle bin.

In some embodiments, a secondary packaging system may include a substantially continuous liner with an open top adapted for positioning in a carton for protecting the carton against moisture and a lid configured for secured engagement with the liner to close the open top of the liner. The system may also include a carton having a wall portion and an open top. The carton may also include a bottom panel and the wall portion may include two side wall panels and two end wall panels. The substantially continuous liner may also include side wall panels, end wall panels, and a bottom panel and the panels of the liner may be positioned adjacent respective panels of the carton. The end wall panels of the carton may include hand holds.

In some embodiments, the liner may include a rim configured to engage a wall portion of the carton. The rim may include a flange and a depending skirt where the flange extends away from the open top of the liner a distance substantially equal to a width of the wall portion and the depending skirt extends downward therefrom. The rim may extend around the full perimeter of the open top of the liner. In some embodiments, the skirt may include an interlocking engagement feature and the lid may include a rim with a flange and a lip, and the lip may include an interlocking engagement feature corresponding to the interlocking engagement feature on the skirt.

In some embodiments, the system may include a positioning feature configured to maintain a position of pre-packaged products to be placed in the liner. The positioning feature may be arranged along a periphery of the liner and may be configured to maintain the position of the pre-packaged products relative to the system. The lid may include a lower surface and the positioning feature may include a recess extending upward into the lower surface of the lid and having a boundary arranged to engage a periphery of the pre-packaged products. The positioning feature may be arranged so as to be positioned within an array of the pre-packaged products where the positioning feature maintains a position of the products relative to the system and a position of the products relative to one another. In some embodiments, the liner includes a bottom and the positioning feature includes a plurality of protrusions extending upward from the bottom of the liner arranged for positioning in a void space between the pre-packaged products. In some embodiments, the protrusions include a bumper portion for maintaining the position of the pre-packaged products and a packing guide portion for guiding the pre-packaged products into a packaged position. In some embodiments, the lid includes a lower surface and the positioning feature includes a plurality of recesses extending into the lower surface of the lid arranged to align with and receive therein a portion of the respective pre-packaged products. The recesses may include a holding portion and a lid guiding portion.

In some embodiments, the liner and the lid may each be made of plastic. In some embodiments, the liner and the lid are made of recyclable high-density polyethylene. In other embodiments, the liner and the lid are made of recyclable linear low-density polyethylene. In some embodiments, the carton, the liner, and the lid may all be made of recyclable material.

In some embodiments, the liner may rest on and be supported by a bottom wall of the carton.

In some embodiments, a portion of the lid may be translucent. In other embodiments, a portion of the lid may be transparent.

In some embodiments, the lid may be connected to the liner with a connection positioned on at least one side. The connection may be a fused connection. The connection may be a mechanical connection. In some embodiments, the lid may be connected to the carton with an adhered connection. In some embodiments, the lid may include a tab extending therefrom adapted for overlapping arrangement with the carton. In some embodiments, the lid may be hingedly secured to the carton on at least one side and removably secured to the carton on at least one other side. The removably secured portion may include a pull tab for releasing the lid from the carton at the respective location. In some embodiments, the lid may be a shoebox-type lid. In some embodiments, the liner may include a top opening and the carton may include a top opening, the respective top openings being arranged perpendicularly to one another and adapted to accommodate side loading of the carton.

In some embodiments, the liner may include an expandable portion for extending upward beyond the sides of the carton to an expanded position to accommodate placement of ice above a contained product. In some embodiments, the liner may includes a catch for securing the liner in the expanded position.

In some embodiments, the positioning feature includes a recess on the outside of the liner and the system includes a label positioned on an outside of the liner to cover the recess to assist in de-nesting the liner from a stack of liners. In some embodiments, the liner includes a plurality of positioning features and one of the positioning features is modified to resist tightly nesting with an adjacent liner in a stack. In some embodiments, the liner includes an airway slot extending along a side thereof to assist with de-nesting of the liner from a stack of liners. In some embodiments, the liner includes a lug configured to rest on the rim of a receiving liner when stacked. In some embodiments, the liner includes a rib configured to catch a received liner when stacked. In some embodiments, the liner includes a rim feature for depressing wherein the rim feature rests on the rim of a received liner when stacked to assist with de-nesting of the liners in a stack.

In some embodiments, an additional liner may be provided for placement in the carton. In another embodiment, an ice accommodating bellows may be arranged within the liner. In another embodiment, the lid may include a recess adapted to suspend a product within the liner.

In the foregoing description various embodiments of the present disclosure have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A cooler system for use with pre-packaged products, the system comprising:

a cardboard carton having an open top and carton side walls that have a top edge surrounding the open top; and a substantially continuous liner, including a bottom panel, and side and end wall panels extending upward from the bottom panel and defining an open top, and a rim that extends outwardly from the open top of the liner, across the top edge of the carton side walls, and downwardly therefrom, the rim overlapping an exterior surface of the carton side walls, forming a waterproof holding volume, the substantially continuous liner further including a plurality of positioning features that are configured to receive the pre-packaged products to maintain a position of the pre-packaged products relative to the liner, wherein the liner is positioned in the carton, wherein at least one positioning feature of the plurality of positioning features is configured to collapse and enlarge the waterproof holding volume.

2. The system of claim 1, wherein the positioning features are arranged along a periphery of the liner and configured to maintain the position of the pre-packaged products relative to the liner and the carton.

3. The system of claim 1, wherein the positioning features are arranged in array and operable to receive the pre-packaged products between the positioning features.

4. The system of claim 3, wherein the positioning features include a plurality of protrusions extending upward from the bottom of the liner arranged for positioning in void spaces between the pre-packaged products.

5. The system of claim 4, wherein the protrusions include a bumper portion for maintaining the position of the pre-packaged products and a packing guide portion for guiding the pre-packaged products into a packaged position.

6. The system of claim 4, further comprising an ice containment portion positioned between protrusions and operable to receive ice and place the ice in contact with the pre-packaged products.

7. The system of claim 6, wherein the ice containment portion includes a bottom surface that is variable in height.

8. The system of claim 1, wherein:

the carton has a bottom panel and the wall portion of the carton includes two side wall panels and two end wall panels; and the panels of the substantially continuous liner are positioned adjacent respective panels of the carton.

9. The system of claim 1, wherein the rim is configured to engage the carton side walls.

10. The system of claim 9, wherein the rim includes a flange and a depending skirt, the flange extending away from the open top of the liner a distance substantially equal to a width of the wall portion of the carton and the depending skirt extending downward therefrom.

11. The system of claim 10, wherein the rim extends around the full perimeter of the open top of the liner.

12. The system of claim 10, further comprising a lid configured for secured engagement with the liner to close the open top of the liner.

13. The system of claim 9, wherein the liner includes a lug configured to rest on the rim of a receiving liner when stacked.

14. The system of claim 1, wherein the liner includes an expandable portion for extending upward beyond the sides of the carton to an expanded position to accommodate placement of ice above a contained product.

15. The system of claim 14, wherein the liner includes a catch for securing the liner in the expanded position.

16. The system of claim 1, further comprising a lid configured for secured engagement with the liner to close the open top of the liner, wherein the lid includes a lid positioning feature configured to maintain the position of pre-packaged products.

17. The system of claim 16, wherein the lid includes a lower surface, and the lid positioning feature includes a recess extending into the lower surface of the lid and having a boundary arranged to engage a periphery of pre-packaged products.

18. The system of claim 16, wherein the lid includes a lower surface, and the lid positioning feature includes a recess extending upward into the lower surface of the lid and having a boundary arranged to engage a periphery of the pre-packaged products.

19. The system of claim 16, wherein the lid includes a lower surface, and the lid positioning feature includes a recess extending upward into the lower surface of the lid and having a boundary arranged to engage a periphery of the pre-packaged products.

20. The system of claim 18, wherein the recesses include a holding portion and a lid guiding portion.

21. The system of claim 1, further comprising a lid configured for secured engagement with the liner to close the top of the liner, wherein:

the rim of the liner includes a flange and a depending skirt, the flange extending away from the open top of the liner and the depending skirt extending downward therefrom; and the lid rim includes a lid flange and a lip, the lid flange configured to oppose all or a portion of the flange of the liner, and the lip extending downward from the lid flange and configured to engage the skirt of the liner.

22. The system of claim 21, wherein the lid rim is configured to remain engaged with the rim of the liner when the liner is removed from the carton.

23. The system of claim 1, wherein the carton side walls have an upper portion extending from the open top of the carton and defining a carton exterior that is substantially vertically straight, the carton side walls extending from the upper portions to a bottom of the carton.

* * * * *